US009944489B2

(12) United States Patent
Arikawa et al.

(10) Patent No.: US 9,944,489 B2
(45) Date of Patent: Apr. 17, 2018

(54) RECORDING MEDIUM PROCESSING APPARATUS

(71) Applicant: FUJI XEROX CO., LTD., Tokyo (JP)

(72) Inventors: Kiichiro Arikawa, Kanagawa (JP); Shiro Suzuki, Kanagawa (JP); Toshihiko Matsuo, Kanagawa (JP); Tsutomu Shiihara, Kanagawa (JP); Hiromitsu Tomioka, Kanagawa (JP); Mitsuyuki Ishida, Kanagawa (JP); Takahiro Ikeda, Kanagawa (JP); Seiji Honda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 84 days.

(21) Appl. No.: 15/014,135

(22) Filed: Feb. 3, 2016

(65) Prior Publication Data

US 2017/0088387 A1 Mar. 30, 2017

(30) Foreign Application Priority Data

Sep. 28, 2015 (JP) ..... 2015-190260

(51) Int. Cl.
*B65H 43/08* (2006.01)
*B65H 31/24* (2006.01)
(Continued)

(52) U.S. Cl.
CPC ..... *B65H 43/08* (2013.01); *B65H 31/02* (2013.01); *B65H 31/22* (2013.01); *B65H 31/24* (2013.01); *B65H 43/06* (2013.01); *G03G 15/5016* (2013.01); *G03G 15/6552* (2013.01); *B65H 2301/4212* (2013.01); *B65H 2404/522* (2013.01); *B65H 2404/5392* (2013.01); *B65H 2405/332* (2013.01); *B65H 2405/36* (2013.01); *B65H 2511/51* (2013.01);
(Continued)

(58) Field of Classification Search
CPC ..... B65H 43/06; B65H 43/08; B65H 31/24
See application file for complete search history.

(56) References Cited

U.S. PATENT DOCUMENTS 7,529,518 B2 * 5/2009 Kubo ..... G03G 15/6552 399/18
7,764,921 B2 7/2010 Horiguchi et al.
2009/0153916 A1 * 6/2009 Borsuk ..... H04N 1/0057 358/474

FOREIGN PATENT DOCUMENTS

JP 08-339107 A 12/1996
JP 2005-179044 A 7/2005
(Continued)

*Primary Examiner* — David M Gray
*Assistant Examiner* — Andrew V Do
(74) *Attorney, Agent, or Firm* — Sughrue Mion, PLLC

(57) ABSTRACT

A recording medium processing apparatus includes a housing that accommodates a processing unit, which is capable of processing a recording medium, and that has an internal space a part of which is open; an internal stacker that is disposed in the internal space and that allows the recording medium to be stacked thereon; a light source that is disposed in a part of the internal stacker and that emits a light beam toward a predetermined position on the internal stacker, the light beam notifying a user of a state in which the recording medium is or is not stacked on the internal stacker; and a reflection member that is disposed in a part of the internal stacker and that reflects the light beam from the light source laterally outward from the internal stacker.

13 Claims, 21 Drawing Sheets

(51) Int. Cl.

| | |
|---|---|
| ***B65H 43/06*** | (2006.01) |
| ***B65H 31/02*** | (2006.01) |
| ***B65H 31/22*** | (2006.01) |
| ***G03G 15/00*** | (2006.01) |

(52) U.S. Cl.
CPC .... *B65H 2511/515* (2013.01); *B65H 2515/60* (2013.01); *B65H 2551/20* (2013.01); *B65H 2553/41* (2013.01); *B65H 2553/414* (2013.01); *B65H 2553/46* (2013.01); *B65H 2801/06* (2013.01); *G03G 2215/00911* (2013.01)

(56) References Cited

FOREIGN PATENT DOCUMENTS

| | | | |
|---|---|---|---|
| JP | 2006-259194 | A | 9/2006 |
| JP | 2014-167518 | A | 9/2014 |

* cited by examiner

RECORDING MEDIUM PROCESSING APPARATUS

CROSS-REFERENCE TO RELATED APPLICATIONS

This application is based on and claims priority under 35 USC 119 from Japanese Patent Application No. 2015-190260 filed Sep. 28, 2015.

BACKGROUND

Technical Field

The present invention relates to a recording medium processing apparatus.

SUMMARY

According to an aspect of the invention, a recording medium processing apparatus includes a housing that accommodates a processing unit, which is capable of processing a recording medium, and that has an internal space a part of which is open; an internal stacker that is disposed in the internal space and that allows the recording medium to be stacked thereon; a light source that is disposed in a part of the internal stacker and that emits a light beam toward a predetermined position on the internal stacker, the light beam notifying a user of a state in which the recording medium is or is not stacked on the internal stacker; and a reflection member that is disposed in a part of the internal stacker and that reflects the light beam from the light source laterally outward from the internal stacker.

BRIEF DESCRIPTION OF THE DRAWINGS

Exemplary embodiments of the present invention will be described in detail based on the following figures, wherein.

DETAILED DESCRIPTION

Overview of Exemplary Embodiments

Figure 1B:
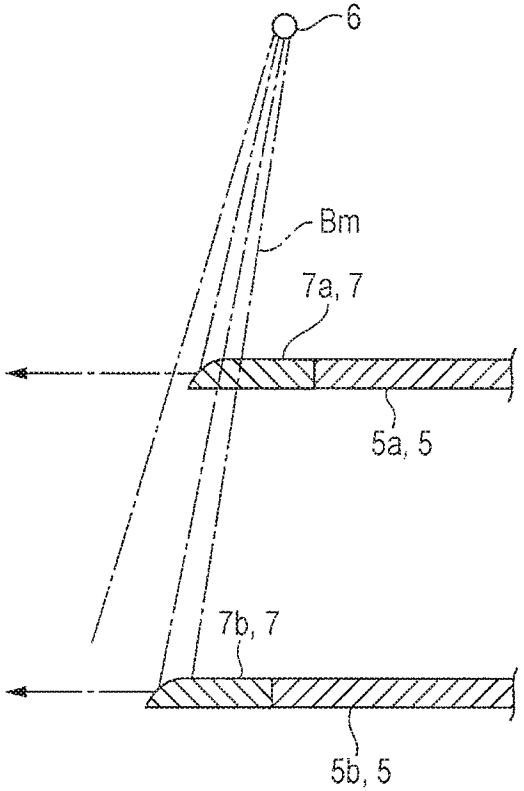
FIG. 1B is a partial schematic view seen in the direction of arrow IB-IB in FIG. 1A.
Figure 1A:
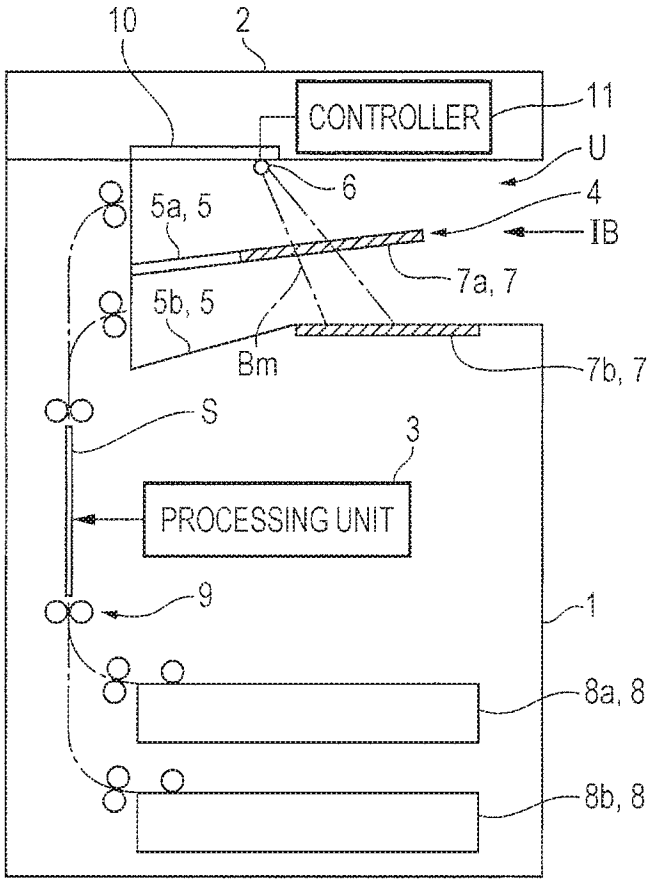
FIG. 1A is a schematic view of an image forming apparatus, which is a recording medium processing apparatus according to an exemplary embodiment of the present invention.

FIG. 1A is a schematic view of an image forming apparatus, which is a recording medium processing apparatus according to an exemplary embodiment of the present invention.

Referring to FIG. 1A, the recording medium processing apparatus includes a housing 1, an internal stacker 4, a light source 6, and a reflection member 7. The housing 1 accommodates a processing unit 3, which is capable of processing a sheet S, and has an internal space U a part of which is open. The internal stacker 4 is disposed in the internal space of the housing 1 and allows a sheet S, which has been processed by the processing unit 3, to be stacked thereon. The light source 6 is disposed in a part of the internal stacker 4 and emits a light beam toward a predetermined position in the internal stacker 4, the light beam notifying a state in which the sheet S is or is not stacked on the internal stacker 4. The reflection member 7 is disposed in a part of the internal stacker 4 and reflects the light beam Bm from the light source 6 laterally outward from the internal stacker 4.

The recording medium processing apparatus, which includes the processing unit 3 that processes the sheet S, may be an image forming apparatus that forms an image on the sheet S and outputs the sheet S, a post-processing apparatus that performs post-processing (punching, folding, stapling, or the like) on the sheet S, or an image forming apparatus equipped with the post-processing apparatus.

Referring to FIG. 1A, an image forming apparatus, which is an example of a recording medium processing apparatus, includes an image capturing unit 2 for capturing an image, disposed in an upper part of the housing 1; the processing unit 3, which is an image forming unit, disposed below the image capturing unit 2; and the internal space U, disposed between the image capturing unit 2 and the processing unit 3. However, the structure of the housing 1 is not limited to this and may be modified as appropriate. For example, the image capturing unit 2 need not be disposed in the housing 1, and the processing unit 3, which is an image forming unit, need not be disposed below the internal space U.

Referring to FIG. 1A, a sheet feeder 8 (in the present example, including two feeders 8*a* and 8*b*) feeds a sheet S toward the processing unit 3; a sheet transport system 9 transports the sheet S, fed from the sheet feeder 8, from the processing unit 3 toward the internal stacker 4; an operation unit 10 is used by a user to operate the image forming apparatus; and a controller 11 controls an image forming operation, which is performed by the processing unit 3, the sheet feeder 8, and the sheet transport system 9. The controller 11 also controls an operation of illuminating the internal stacker 4, which is performed by the light source 6.

The image capturing unit 2 may be either of a type in which a scanner is moved or a type in which a scanner is fixed. The processing unit 3, which is an example of an image forming unit, may be any of an electrophotographic image forming unit, an electrostatic image forming unit, an inkjet image forming unit, and the like. An image formed by the processing unit 3 may be any of a monochrome image, a multicolor image, a full-color image, and the like.

The entirety of the internal space U may be used as the internal stacker 4. However, as illustrated in FIGS. 1A and 1B, plural stack members 5 (in FIGS. 1A and 1B, two stack members 5*a* and 5*b*) may be disposed so as to partition the internal space U into plural regions in the vertical direction. The stack members 5 may be independent from the housing 1 or integrated with a part of the housing 1.

The light source 6, which may be any appropriate device, is preferably an LED, which allows the light intensity and the emission pattern to be easily adjusted. In order to effectively restrict the irradiation region of the light beam Bm emitted from the light source 6 toward the reflection member 7, preferably, the back side of the light source 6 is covered by a reflector or the like so as to allow the irradiation region of the light beam Bm to be adjusted.

Furthermore, the reflection member 7, which is disposed in a part of the internal stacker 4, may be made of any material, may have any shape, or there may be any number of reflection members 7, as long as the reflection member(s) 7 is/are capable of reflecting the light beam Bm from the light source 6 laterally outward from the internal stacker 4.

The recording medium processing apparatus according to the exemplary embodiment may be structured as follows.

The internal stacker 4 may include plural stack members 5 (in the present example, two stack members 5*a* and 5*b*) so as to have plural stack regions that are arranged vertically, and the reflection member 7 (for example, a reflection member 7*a* or 7*b*) may be disposed on at least one of the stack members 5. In this case, because the plural stack members 5 (5*a* and 5*b*) provide plural stack regions and the reflection member 7 is disposed on at least one of the stack members 5 (5*a* or 5*b*), it is possible for a user to recognize a state in which the sheet S is or is not stacked on the stack members 5.

The reflection member 7 may be structured as follows.

First, the reflection member 7 may have a diffusely reflecting surface that diffusely reflects the light beam Bm from the light source 6 laterally outward from the internal stacker 4. In this case, the diffusely reflecting surface is, for example, a C-shaped reflecting surface. The diffusely reflecting surface, which reflects a light beam toward a wide area around the recording medium processing apparatus, is capable of notifying users in a wide area around the recording medium processing apparatus of a state in which a recording medium is or is not stacked on the stack member 5.

Second, the reflection member 7 may have a reflecting surface that reflects the light beam Bm from the light source 6, the reflecting surface being textured to have small asperities. In this case, the reflecting surface, which is textured to have small asperities, diffusely reflects the light beam over a wide area with an appropriately reduced intensity.

Third, a part of the stack member 5 of the internal stacker 4 serves as the reflection member 7. In this case, because a part of the stack member 5 also serves as the reflection member 7, the reflection member 7 is not likely to obstruct an operation of stacking the sheet S on the stack member 5.

Fourth, the reflection member 7 may be a translucent member. In this case, because the reflection member 7 is a translucent member, the reflection member 7 has a notification function and an illumination function. The notification function is a function of reflecting a part of the light beam Bm from the light source 6 toward an area around the image forming apparatus. The illumination function is a function of transmitting the remaining part of the light beam Bm from the light source 6 and irradiating a part of the stack members 5 (for example, the stack member 5*b*) located below the reflection member 7 (for example, the reflection member 7*a*) of the internal stacker 4.

Fifth, in a case where the internal stacker 4 includes the plural stack members 5 (for example, the stack members 5*a* and 5*b*), the reflection member 7 may be disposed on at least an uppermost one of the plural stack members 5 (for example, the stack member 5*a*), and the reflection member 7 may be a translucent member. In this case, where the internal stacker 4 includes the plural stack members 5, when the reflection member 7 (for example, the reflection member 7*a*) is disposed on the uppermost one of the stack members 5 (for example, the stack member 5*a*) and the reflection member 7 (for example, the reflection member 7*a*) is a translucent member, the reflection member 7 has the notification function and the illumination function of illuminating the stack member 5 (for example, the stack member 5*b*) located below the reflection member 7.

Sixth, the reflection members 7 may be disposed on all of the plural stack members 5 (for example, the stack members 5*a* and 5*b*) so as to face an irradiation range of the light beam Bm emitted from the light source 6. In this case, where the reflection members 7 (7*a* and 7*b*) are disposed on the plural stack members 5 (5*a* and 5*b*), it is necessary to make the irradiation region of the light beam Bm from the light source 6 be on both of the reflection members 7 (7*a* and 7*b*). By doing so, the reflection members 7 (7*a* and 7*b*) reflect light toward an area around the image forming apparatus.

Seventh, the reflection member 7 may be disposed on a region of the internal stacker 4 excluding a region on which a frequently used standard-sized sheet S is to be placed. In this case, even when a frequently used standard-sized sheet S is stacked on the internal stacker 4, the standard-sized sheet S does not overlap the reflection member 7 on the stack member 5. Thus, when the standard-sized sheet S is stacked, the light beam Bm from the light source 6 is reflected by the reflection member 7 toward an area around the image forming apparatus.

The recording medium processing apparatus may have a facsimile function with which an image that is captured by the image capturing unit 2 is transmitted through a communication line and the processing unit 3, which is an image forming unit, forms an image transmitted thereto through a communication line. In the image forming apparatus having the facsimile function, the internal stacker 4 may include a dedicated stack member 5 that allows a sheet S on which the transmitted image has been formed by using the facsimile function to be stacked thereon, and the reflection member 7 is disposed on the dedicated stack member 5. In this case, where the image forming apparatus is a multifunctional machine having the facsimile function and includes the dedicated stack member 5 for stacking a sheet S processed by using the facsimile function thereon, it is possible for a user to check the presence/absence of a facsimile output. Moreover, because the reflection member 7 is disposed on the dedicated stack member 5, it is possible for a user away from the image forming apparatus to check whether the light beam is reflected from the reflection member 7 of the dedicated stack member 5.

The dedicated stack member 5 may be standard equipment or optional equipment. In the case where the dedicated stack member 5 is optional equipment, the internal stacker 4 may be configured as follows: a stack member 5 (for example, the stack member 5*b*), which is standard equipment and which allows a sheet S on which the processing unit 3 has formed a non-facsimile image to be stacked thereon, is disposed below the dedicated stack member 5 (for example, the stack member 5*a*); the reflection member 7 (for example, the reflection member 7*b*) is disposed on the standard-equipment stack member 5 (5*b*); the dedicated stack member 5, which is optional equipment, is removably disposed in a region that partitions the internal space vertically; and a reflection member 7 (for example, the reflection member 7*a*) made of a translucent material is disposed on the dedicated stack member 5 in a region including an optical path of the light beam from the light source 6 to the reflection member 7 (7*b*) disposed on the standard-equipment stack member 5 (5*b*).

Thus, when the dedicated stack member 5 (5*a*) is optional equipment, it is necessary to enable notification of a state in which the sheet S is or is not stacked on the internal stacker 4 in both of a case where the image forming is not equipped the dedicated stack member 5 (5*a*) and a case where the image forming apparatus is equipped with the dedicated stack member 5 (5*a*).

The light source 6 may emit a non-white light beam. In this case, it is possible to clearly distinguish the color of the light beam from the color of a sheet S, which is usually white-based. Moreover, even when a large-sized recording medium (which is usually white-based) overlaps the reflection member 7, it is possible to recognize an optical path along which a light beam Bm that has passed through the sheet S is reflected by the reflection member 7.

The light source may be controlled as follows. The image forming apparatus may include a controller 11 that controls, when there are one or more notifications about the state in which the sheet S is or is not stacked on the internal stacker 4, an emission pattern of the light beam Bm from the light source 6 in accordance with contents of the notifications. In this case, because the controller 11 controls the emission pattern of illumination beam Bm from the light source 6 in accordance with the contents of the notifications about the state in which the sheet S is or is not stacked on the internal stacker 4, it is possible to display the contents of the notifications by using distinct emission patterns.

When notifying a state in which an operation of stacking a sheet S processed by the processing unit 3 is in progress in the internal stacker 4, the controller 11 may select an emission pattern of the light beam Bm from the light source 6 in which the brightness level of the light beam Bm is gradually changed so that increase and decrease of the brightness level are repeated. In this case, the state in which the processing unit 3 is in operation is displayed by using a regularly cyclic emission pattern, so that it is possible for a user to check the state with a pleasant visual effect.

The internal stacker 4 may include a stack member 5 on which a recording medium processed by the processing unit is to be stacked, and the stack member may include a detector (not shown) that is capable of detecting the presence/absence of the sheet S, and, when the detector detects the presence of the sheet S on the stack member as the state in which the sheet S is or is not stacked on the internal stacker 4, the controller 11 may activate the light source 6 with a predetermined emission pattern on the basis of a detection signal of the detector. In this case, where the controller 11 notifies a user that the sheet S is stacked on the stack member 5 of the internal stacker 4, the detector detects the sheet S on the stack member 5, the controller 11 activates the light source 6 on the basis of the detection result, and the controller 11 causes the reflection member 7 to reflect the light beam Bm so as to notify a user in an area around the image forming apparatus of the presence of the sheet S on the stack member 5.

Hereinafter, exemplary embodiments, which are illustrated the figures, will be described in detail.

First Exemplary Embodiment

Figure 2:
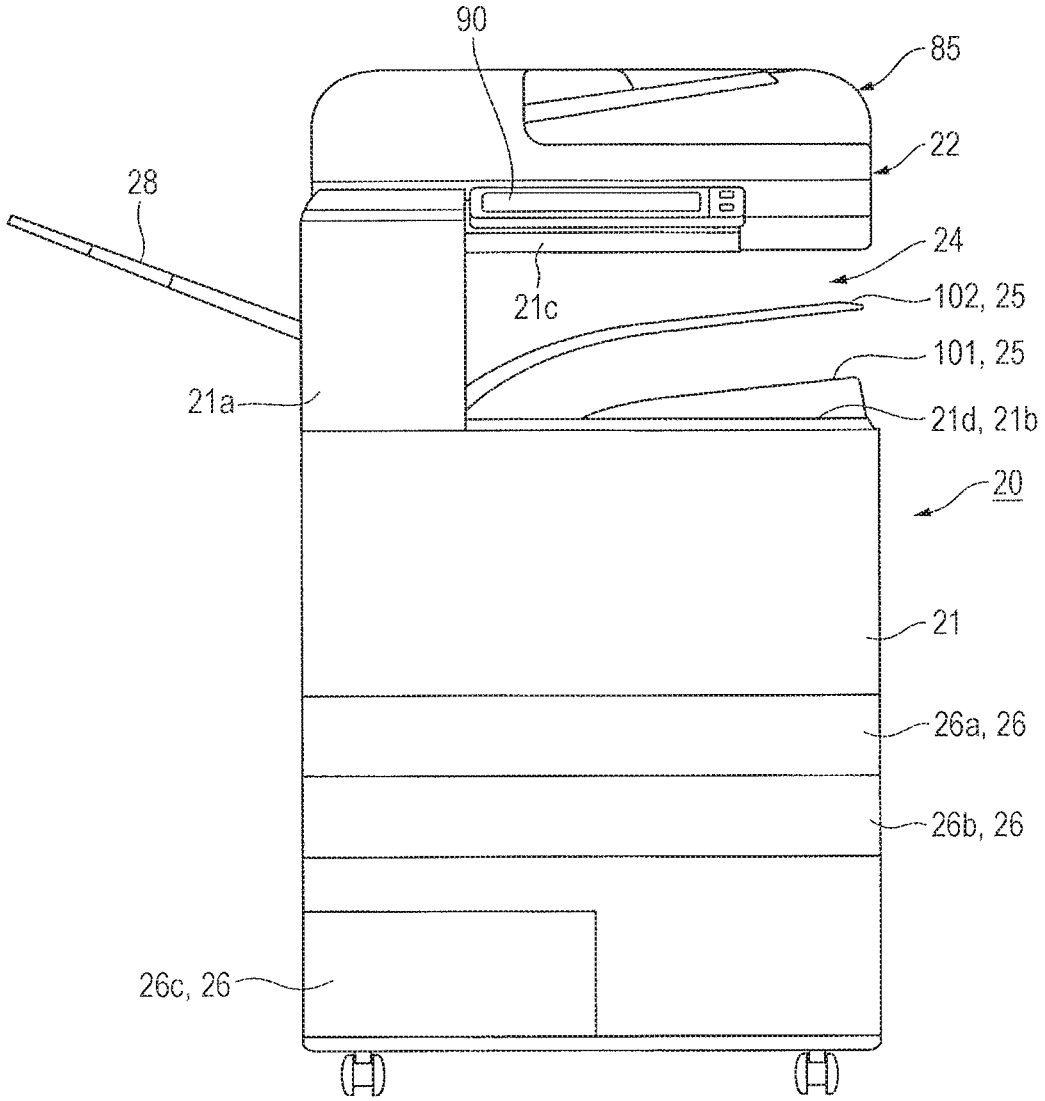
FIG. 2 is an external view of an image forming apparatus according to a first exemplary embodiment.
Figure 3:
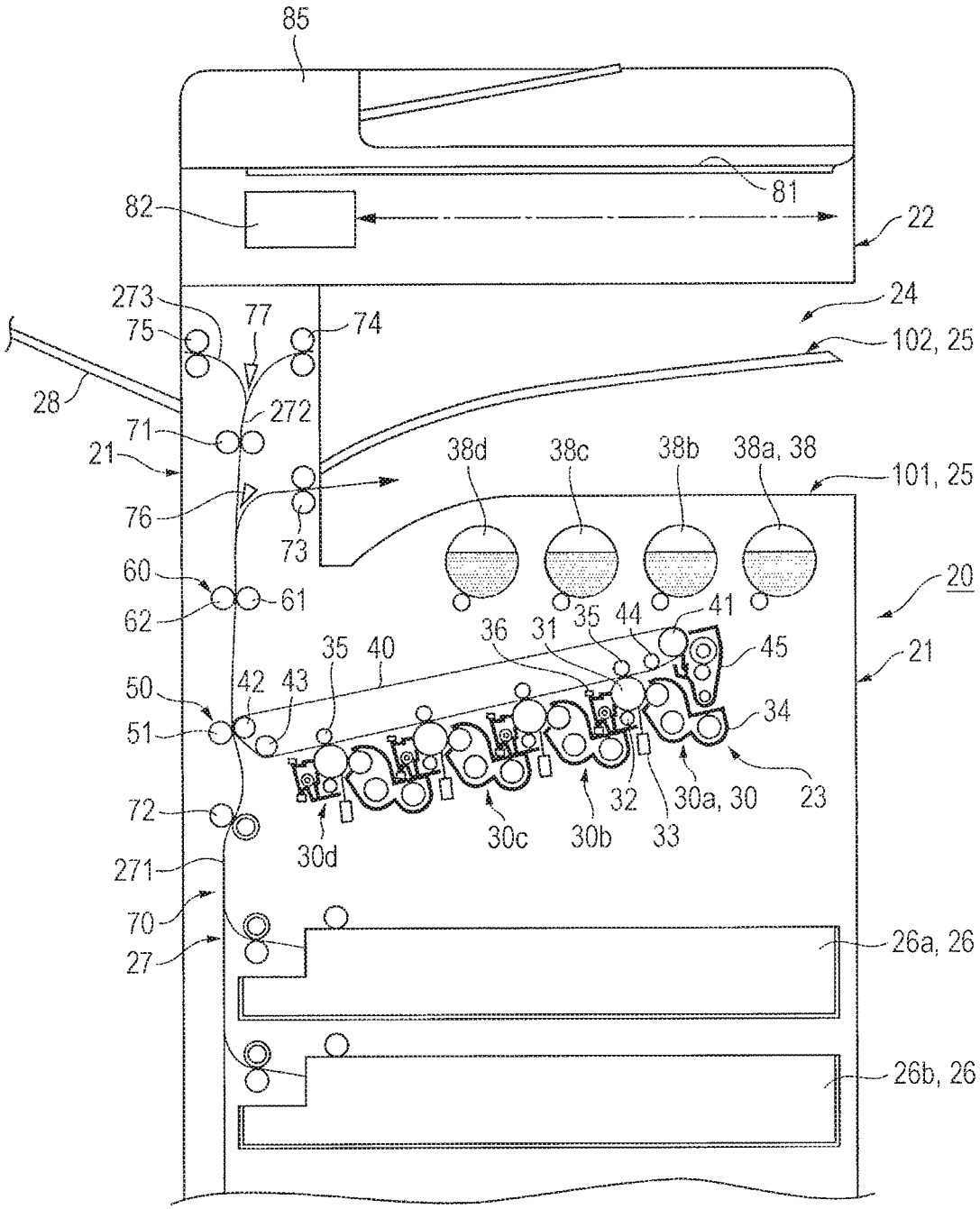
FIG. 3 is a schematic view illustrating the overall structure of the image forming apparatus according to the first exemplary embodiment.

FIG. 2 is an external view of an image forming apparatus 20 according to a first exemplary embodiment. FIG. 3 is a schematic view illustrating the overall structure of the image forming apparatus 20.

Overall Structure of Image Forming Apparatus

In the present exemplary embodiment, the image forming apparatus 20 is a multifunctional machine having a printer function, a scanner function, a copier function, and a facsimile function.

Referring to FIGS. 2 and 3, the image forming apparatus 20 includes a housing 21, a scanner 22, an image forming engine 23, an internal space 24, and an internal stacker 25, sheet feeders 26, and a sheet transport path 27. The housing 21 has a substantially rectangular parallelepiped shape. The scanner 22, which is an example of an image capturing unit for capturing an image, is disposed in an upper part of the housing 21. The image forming engine 23, which is an example of an image forming unit, is disposed in a part of the housing 21 below the scanner 22 and forms an image on a sheet S (see FIGS. 13A to 14C), which is an example of recording medium. The internal space 24 is formed in a part of the housing 21 between the scanner 22 and the image forming engine 23. After the image forming engine 23 has formed an image on a sheet S, the sheet S is output to and stacked on the internal stacker 25. The sheet feeders 26 (in the present example, three sheet feeders 26*a* to 26*c*), which are examples of a sheet feeding unit, are disposed in the housing 21 below the image forming engine 23. A sheet S, fed from the sheet feeder 26, is transported through the sheet transport path 27, which extends in a substantially vertical direction, through an image transfer region of the image forming engine 23 toward the internal stacker 25.

In the present exemplary embodiment, the scanner 22 includes a document table 81, on which a document is placed, and captures an image of the document placed on the document table 81 by using an image capturing unit 82. The scanner 22 sends image signals for color components to an image writer 33 through an image processing unit (not shown). An automatic document feeder 85, which is openable or closable, is disposed on the document table 81. When closed, the automatic document feeder 85 is capable of automatically feeding a document.

In the present exemplary embodiment, the image forming engine 23 includes image forming units 30 (to be specific, image forming units 30*a* to 30*d*), an intermediate transfer belt 40, a simultaneous transfer unit 50, and a fixing unit 60. The image forming units 30 form plural color component images by using an electrophotographic method. The images formed by the image forming units 30 are temporarily transferred to the intermediate transfer belt 40 before the images are transferred to the sheet S. The simultaneous transfer unit 50 simultaneously transfers the color component images, transferred to the intermediate transfer belt 40, to the sheet S. The fixing unit 60 fixes the images, transferred to the sheet S by the simultaneous transfer unit 50, by using heat and pressure.

Each of the image forming units 30 (30*a* to 30*d*) includes, for example, a photoconductor drum 31, a charger 32, the image writer 33, a developing unit 34, a transfer unit 35, and a cleaner 36. The charger 32 charges the photoconductor drum 31. The image writer 33, which is an LED array or the like, writes an electrostatic latent image on the photoconductor drum 31 by using light. The developing unit 34 develops the electrostatic latent image formed on the photoconductor drum 31 by using a color developer. The transfer unit 35 transfers a color developer image on the photoconductor drum 31 to the intermediate transfer belt 40. The cleaner 36 removes substances remaining on the photoconductor drum 31.

Toner supply units 38 (38*a* to 38*d*) supply color developers to the developing units 34 of the image forming units 30. In the present example, each of the image forming units 30 (30*a* to 30*d*) includes the image writer 33. Alternatively, for example, a laser scanning device that is shared by all the image forming units 30 may be used.

In the present exemplary embodiment, the intermediate transfer belt 40 is looped over plural span rollers 41 to 44 and is rotated by, for example, the span roller 41. An intermediate transfer belt cleaner 45, which removes substances remaining on the intermediate transfer belt 40, is disposed downstream of the simultaneous transfer unit 50 in the direction in which the intermediate transfer belt 40 rotates.

The simultaneous transfer unit 50 includes a transfer roller 51, which faces, for example, the span roller 42 for supporting the intermediate transfer belt 40. The transfer roller 51 nips the intermediate transfer belt 40 between the transfer roller 51 and the span roller 42. A transfer electric field is formed between the transfer roller 51 and the span roller 42 when a transfer voltage is applied.

The fixing unit 60 is disposed in the sheet transport path 27 at a position downstream of the simultaneous transfer unit 50 in the transport direction of the sheet S. The fixing unit 60 includes, for example, a heat fixing roller 61 and a press fixing roller 62 that rotates while being in pressed contact with the heat fixing roller 61. When a sheet S, having an unfixed image thereon, passes through a gap between the fixing rollers 61 and 62, the unfixed image is fixed to the sheet S by heat and pressure.

Internal Stacker

Figure 4:
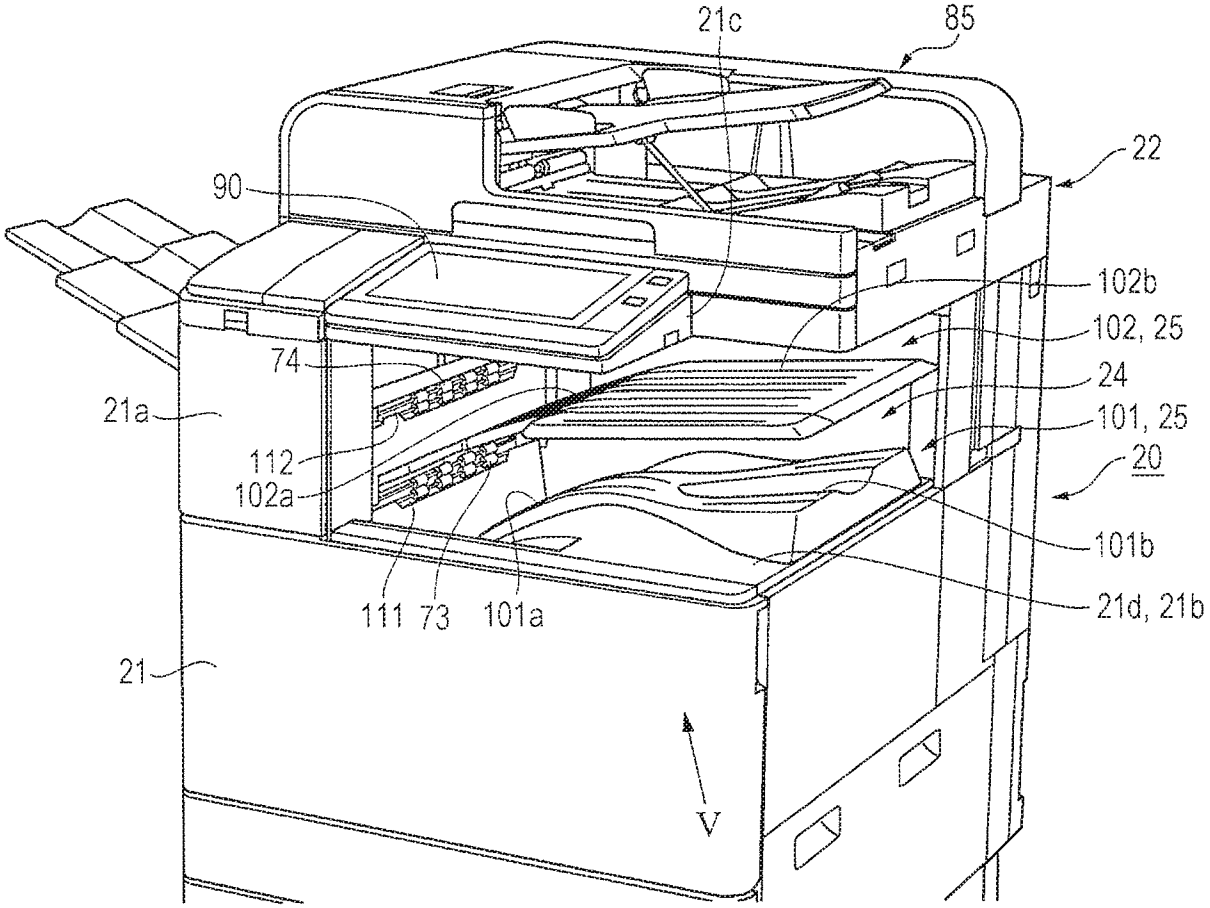
FIG. 4 is a partial perspective view of the image forming apparatus according to the first exemplary embodiment, illustrating an internal stacker and the surrounding region.

Referring to FIGS. 2 to 4, in the present exemplary embodiment, the housing 21 includes a pillar 21*a* and an upper portion 21*b*. The upper portion 21*b* has a substantially rectangular parallelepiped shape. The pillar 21*a* protrudes vertically along two adjacent sides of the upper portion 21*b* and supports the scanner 22. The internal space 24 is surrounded by the scanner 22, the pillar 21*a*, and the upper portion 21*b* (excluding the pillar 21*a*) of the housing 21. The internal space 24 serves as the internal stacker 25, which is a sheet stacking space.

In the present example, the internal stacker 25 includes a first stack tray 101, which is the upper portion 21*b* (excluding the pillar 21*a*) of the housing 21, and a second stack tray 102, which is disposed between the first stack tray 101 and the scanner 22. The internal stacker 25 has stack regions for stacking sheets S, which are separated by the second stack tray 102, in an upper part and a lower part of the internal space 24.

In particular, in the present example, the second stack tray 102 is removably attached to the pillar 21*a* of the housing 21 and serves as a dedicated stack tray for facsimile output.

The pillar 21*a* of the housing 21 has output openings 111 and 112, through which the sheets S are output to the first stack tray 101 and the second stack tray 102. The first stack tray 101 and the second stack tray 102 respectively include positioning walls 108 (see FIG. 9A), inclined portions 101*a* and 102*a*, and extended portions 101*b* and 102*b*. The positioning walls 108 are each capable of positioning one end of a sheet S toward the output openings 111 and 112. The inclined portions 101*a* and 102*a* extend diagonally from the positioning walls 108 at large angles. The extended portions

101*b* and 102*b* extend from the upper ends of the inclined portions 101*a* and 102*a* at smaller angles than the inclined portions 101*a* and 102*a*.

Figure 7:
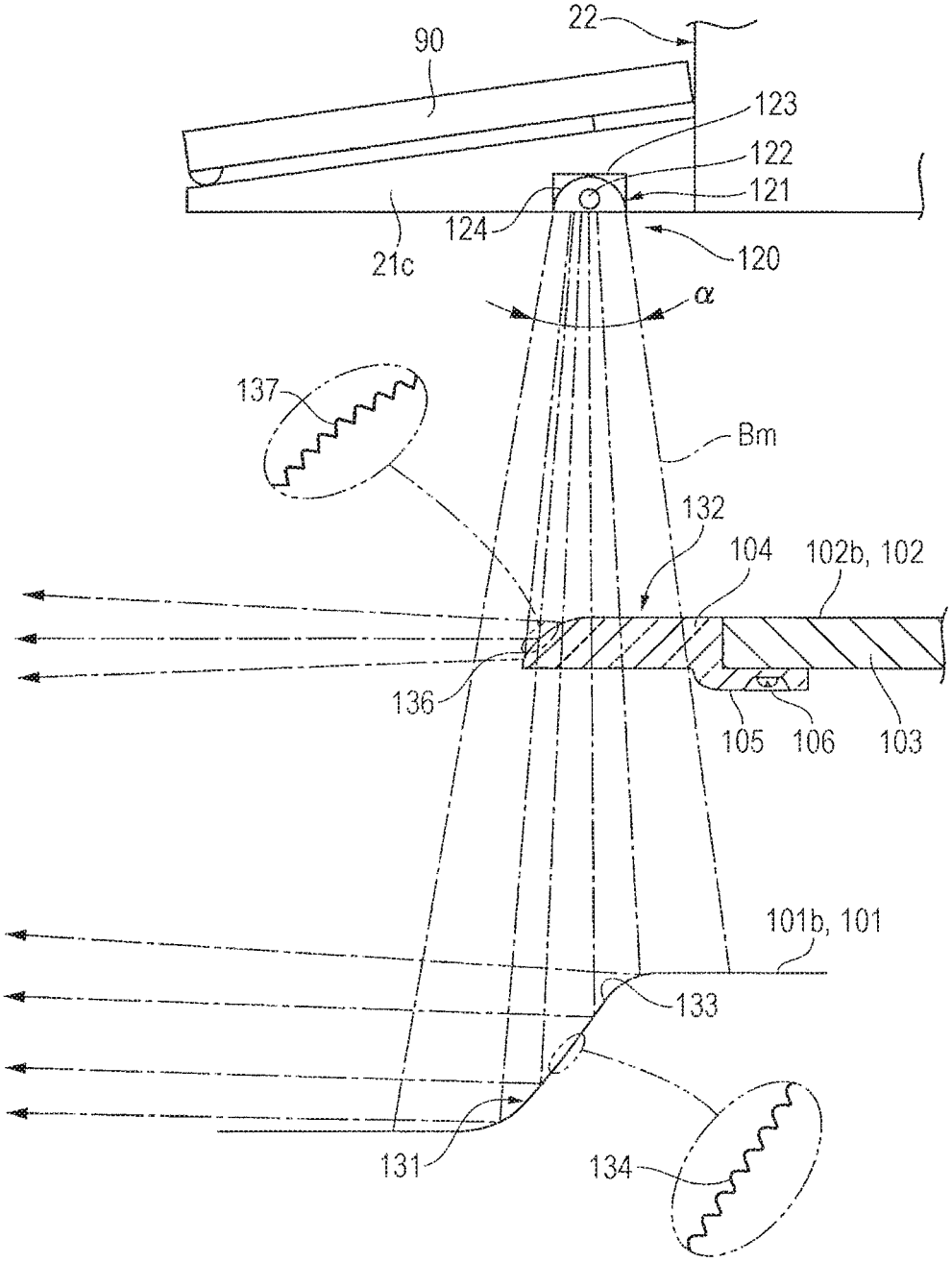
FIG. 7 is schematic view illustrating the internal stacker seen in the direction of arrow VII in FIG. 6.

Referring to FIGS. 4 and 7, the first stack tray 101 is integrally formed with the upper portion 21*b* (excluding the pillar 21*a*) of the housing 21 so as to be stepped upward at a position slightly backward from an operation panel 90.

Figure 5:
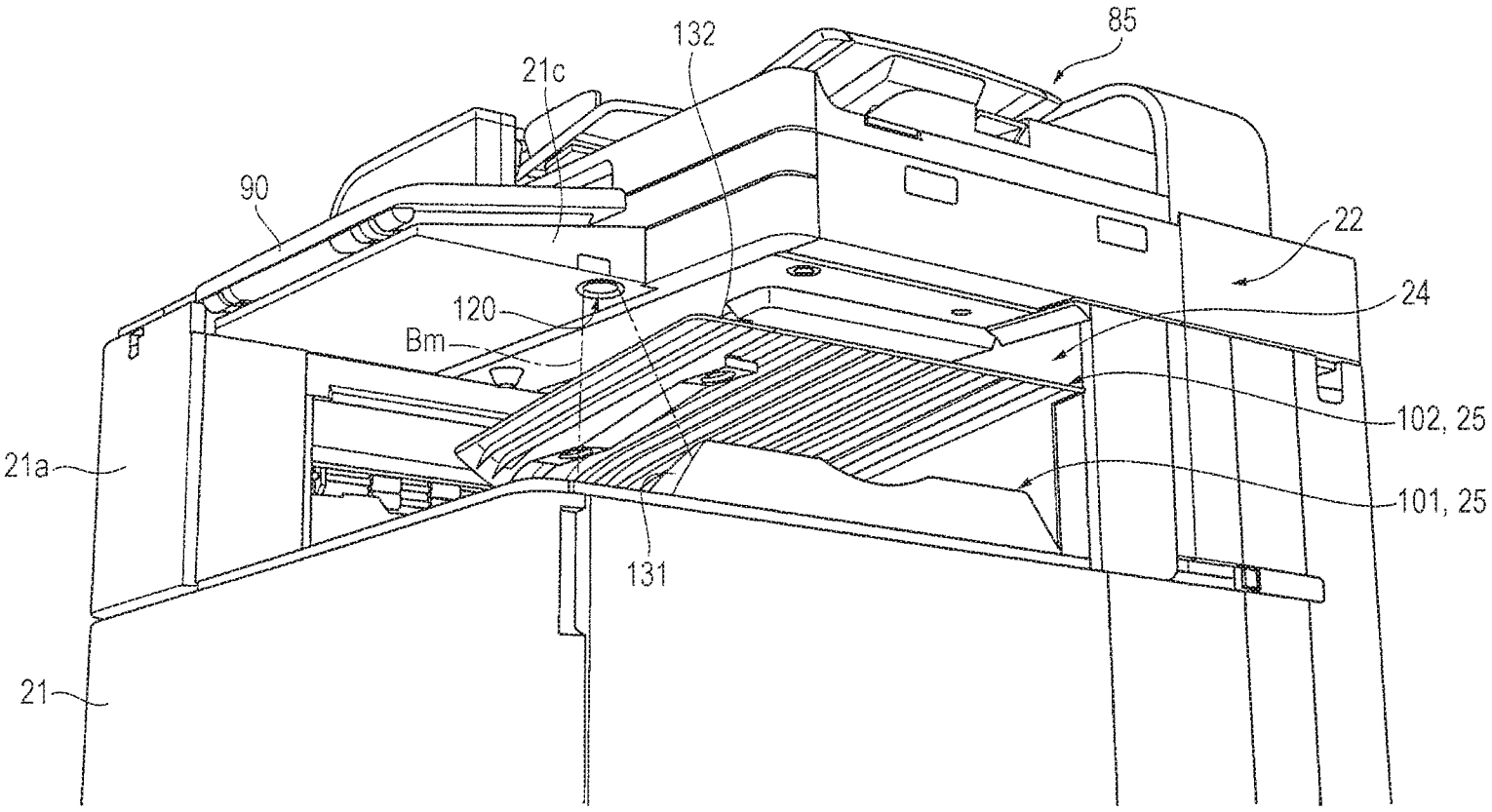
FIG. 5 is a partial perspective view illustrating the internal stacker of the image forming apparatus according to the first exemplary embodiment, seen in the direction of arrow V in FIG. 4.
Figure 6:
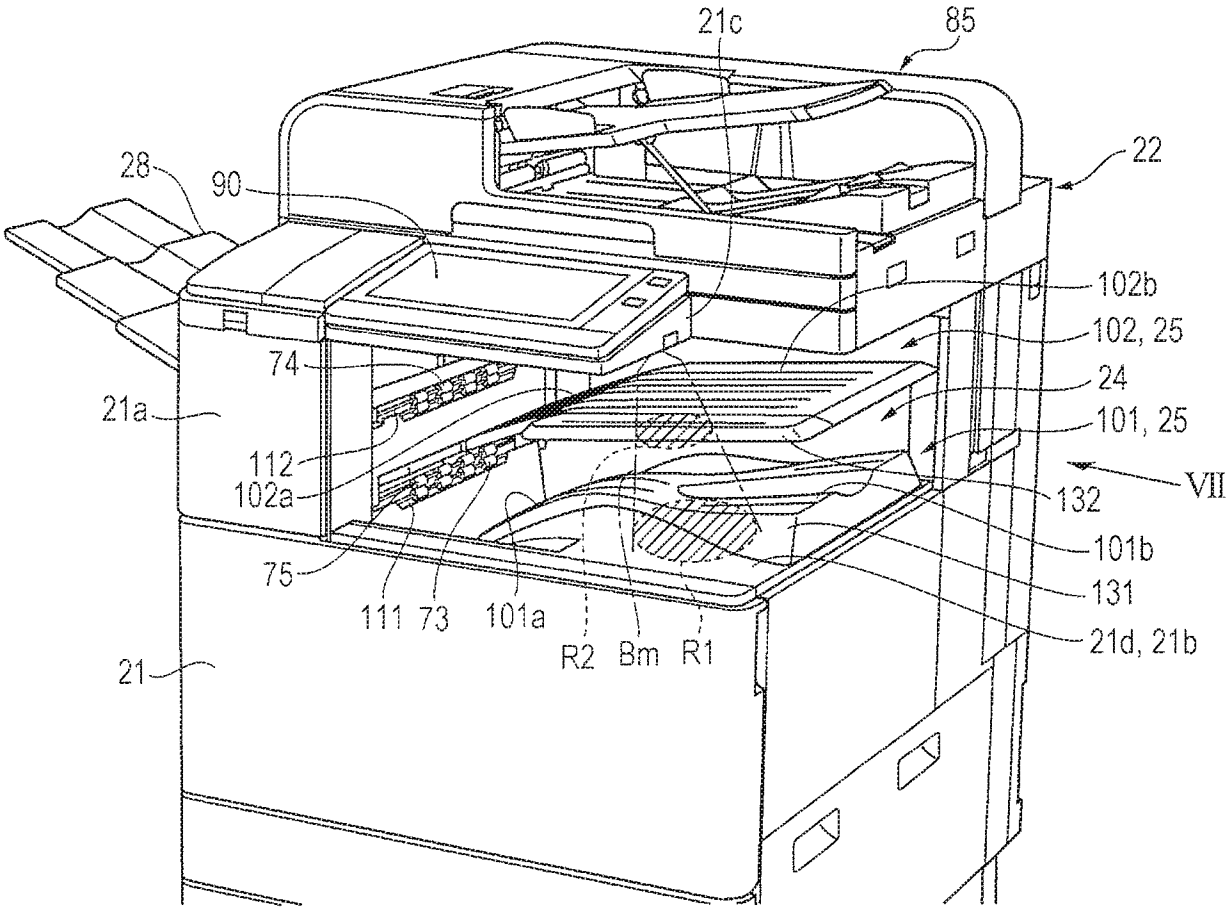
FIG. 6 is a partial perspective view schematically illustrating how the internal stacker of the image forming apparatus according to the first exemplary embodiment is illuminated.

Referring to FIGS. 4 to 6, in the present exemplary embodiment, a support table 21*c*, which is substantially rectangular, is disposed on a part of the pillar 21*a* of the housing 21 that does not support the scanner 22. The support table 21*c* is disposed adjacent to the document table 81 of the scanner 22 so as to extend in a substantially horizontal direction. The operation panel 90 of the image forming apparatus is disposed on the support table 21*c*.

A side stack tray 28 protrudes sideways from the housing 21. The side stack tray 28, which allows a sheet S on which the image forming engine 23 has formed an image to be stacked, is an example of a side stacker.

Sheet Transport System

Referring to FIG. 3, in the present exemplary embodiment, the sheet transport path 27 includes a first transport path 271, a second transport path 272, and a third transport path 273. The first transport path 271 transports a sheet S, which is fed by the sheet feeder 26 (to be specific, one of the sheet feeders 26*a* to 26*c*), through the image forming engine 23 toward the first stack tray 101 of the internal stacker 25. The second transport path 272, which branches off from the first transport path 271, transports the sheet S toward the second stack tray 102 of the internal stacker 25. The third transport path 273, which branches off from the second transport path 272, transports the sheet S to the side stack tray 28, which is an example of a side stacker.

A sheet transport system 70, which transports a sheet S fed from the sheet feeder 26, is disposed in the sheet transport path 27. The sheet transport system 70 includes an appropriate number of transport rollers 71, a registration roller 72, output rollers 73 to 75, a first switching gate 76, and a second switching gate 77. The transport rollers 71 are disposed at predetermined distances in the sheet transport path 27. The registration roller 72, which is disposed in the sheet transport path 27 at a position upstream of the simultaneous transfer unit 50 in the transport direction of the sheet S, transports the sheet S to a simultaneous transfer region after adjusting the position of the sheet S. The output rollers 73 to 75, which are disposed near the outlets of the first to third transport paths 271 to 273, output the sheet S toward the first stack tray 101, the second stack tray 102, and the side stack tray 28. The first switching gate 76 selectively switches between the first transport path 271 and the second transport path 272. The second switching gate 77 selectively switches between the second transport path 272 and the third transport path 273.

Illumination Mechanism of Internal Stacker

Referring to FIGS. 4 to 8, in the present exemplary embodiment, the internal stacker 25 includes an illumination mechanism 120 for illuminating the internal stacker 25.

In the present example, the illumination mechanism 120 includes a light source 121, a first reflection member 131, and a second reflection member 132. The light source 121 is disposed on a part of the support table 21*c* of the housing 21. The first reflection member 131, which is disposed on a part of the extended portion 101*b* of the first stack tray 101 near the operation panel 90, reflects a light beam Bm, emitted from the light source 121, laterally outward from the internal space 24. The second reflection member 132, which is disposed on a part of the extended portion 102*b* of the second stack tray 102 near the operation panel 90, reflects the light beam Bm, emitted from the light source 121, laterally outward from the internal space 24.

Light Source

As the light source 121, an illumination LED 122 that is capable of emitting non-white light, such as blue light, is used. The LED 122 is disposed in a case 123, and the back side of the LED 122 in the case 123 is covered with a reflector 124, which is an example of a reflection plate.

The light source 121 emits the light beam Bm toward the edges, near the operation panel 90, of the extended portions 101*b* and 102*b* of the first stack tray 101 and the second stack tray 102 with a predetermined irradiation range $\alpha$.

First Reflection Member

In the present example, as described above, the first stack tray 101 is integrally formed on the upper portion 21*b* (excluding the pillar 21*a*) of the housing 21 at a position backward from a stepped portion 21*d*, which is a lower part of the upper portion 21*b* near the operation panel 90. Referring to FIGS. 4 and 7, the first reflection member 131 is integrally formed near the boundary between the first stack tray 101 and the stepped portion 21*d*.

In the present example, the first reflection member 131 includes an inclined portion 133, which is inclined downward toward the stepped portion 21*d* at a predetermined angle (in the present exemplary embodiment, in the range of 40 to 50°) with respect to a horizontal surface. The surface of the inclined portion 133 is textured to have small asperities 134. As necessary, the stepped portion 21*d* may be textured to have small asperities.

Second Reflection Member

Referring to FIGS. 4 to 7, in the present example, the second stack tray 102 includes an opaque member 103 and a translucent member 104. The opaque member 103 is a part of the extended portion 102*b* disposed in a region excluding a substantially rectangular region near the operation panel 90. The translucent member 104 is disposed in this substantially rectangular region. The translucent member 104 includes a substantially L-shaped attachment piece 105 extending along the lower surface of the opaque member 103. The translucent member 104 is attached to the opaque member 103 by fixing the attachment piece 105 with a fastener 106, such as a screw.

The second reflection member 132 is the translucent member 104, which also serves as a part of the second stack tray 102. A part of the translucent member 104 near the operation panel 90 has a curved reflecting surface 136. A part of the translucent member 104 including the reflecting surface 136 is textured to have small-asperity surface 137.

Irradiation Region Irradiated by Light Source

Referring to FIGS. 4 to 7, in the present exemplary embodiment, the light beam Bm from the light source 121 irradiates an irradiation region R2, which includes a part of the reflecting surface 136 of the second reflection member 132. In the present example, the irradiation region R2 includes a region that faces the second reflection member 132 and a region that does not face the second reflection member 132. Therefore, the light beam Bm from the light source 121 illuminates a region including a part of the second reflection member 132. A part of the light beam Bm passes through the second reflection member 132, which is the translucent member 104, and irradiates a region below the second reflection member 132. Another part of the light beam Bm that does not pass through the second reflection member 132 directly irradiates a region below the second reflection member 132. The remaining part of the light beam Bm is reflected by the reflecting surface 136 of the second reflection member 132 laterally outward from the internal space 24.

In the present exemplary embodiment, the part of the light beam Bm from the light source 121 that passes through the second reflection member 132 irradiates a region including the inclined portion 133 of the first reflection member 131. The other part of the light beam Bm that does not pass through the second reflection member 132 directly irradiates a region including the inclined portion 133 of the first reflection member 131 and the stepped portion 21*d* facing the inclined portion 133. Both of these regions correspond to an irradiation region R1 of the first reflection member 131. Therefore, the light beam Bm from the light source 121 illuminates a region including the inclined portion 133 of the first reflection member 131, and a part of the light beam Bm is reflected by the inclined portion 133 of the first reflection member 131 laterally outward from the internal space 24.

Field of View from First and Second Reflection Members

Figure 8:
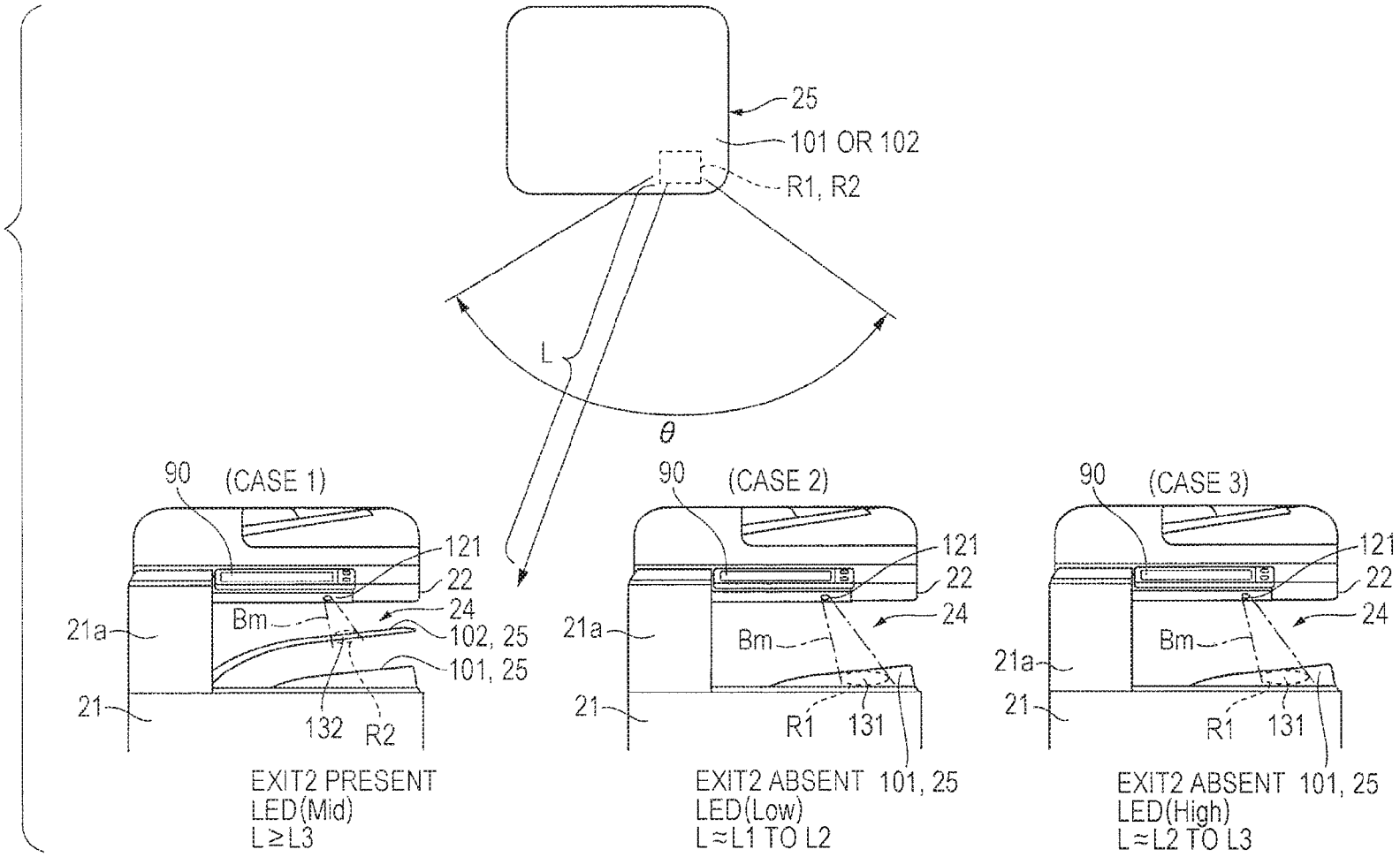
FIG. 8 illustrates a field of view from a reflection member of the image forming apparatus according to the first exemplary embodiment.

FIG. 8 illustrates the field of view of the first reflection member 131 and the second reflection member 132.

Referring to FIG. 8, the first reflection member 131 and the second reflection member 132 are capable of diffusely reflecting light beam Bm emitted from the light source 121 laterally outward from the internal space 24 with a field of view having an angle θ (in the present example, in the range of 120° to 180°) and is capable of appropriately changing a reachable distance L of the light beam Bm.

Case 1 is a case where the second reflection member 132 is present (represented as "EXIT 2 present" in FIG. 8) and the emission intensity of the LED 122, which is the light source 121, is set at a medium level (Mid). In this case, the reachable distance L of the light beam Bm reflected by the second reflection member 132 is L3 (for example, 15 m) or larger.

Case 2 is a case where the second reflection member 132 is absent (represented as "EXIT 2 absent" in FIG. 8) and the emission intensity of the LED 122, which is the light source 121, is set at a low level (Low). In this case, the reachable distance L of the light beam Bm reflected by the first reflection member 131 is in the range of L1 (for example, 5 m) to L2 (for example, 10 m).

Case 3 is a case where the second reflection member 132 is absent (represented as "EXIT 2 absent" in FIG. 8) and the emission intensity of the LED 122, which is the light source 121, is set at a high level (High). In this case, the reachable distance L of the light beam Bm reflected by the first reflection member 131 is in the range of L2 (for example, 10 m) to L3 (for example, 15 m).

Detection of Presence/Absence of Sheet on Second Stack Tray

Figure 9A:
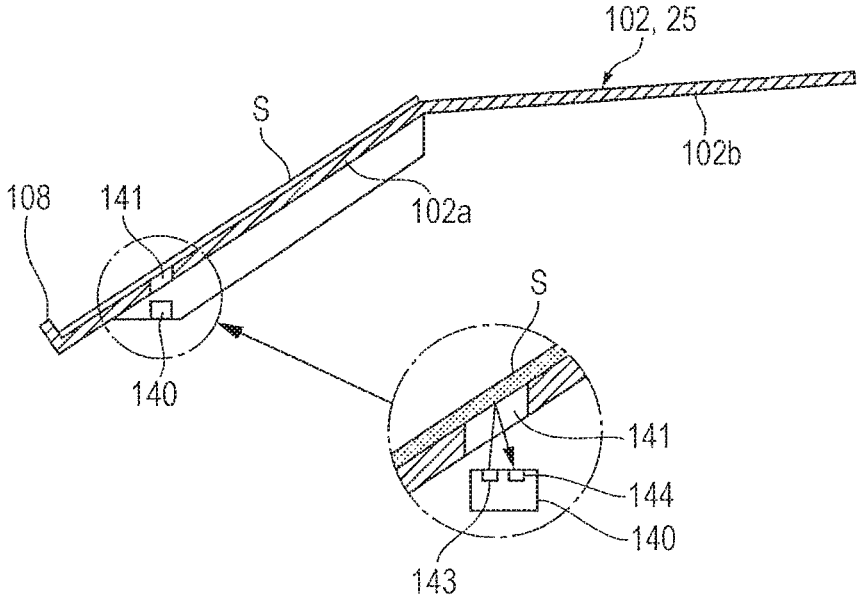
FIG. 9A illustrates an example of a detection structure for detecting the presence/absence of a sheet on a second stack tray, which is used in the first exemplary embodiment.

Referring to FIG. 9A, in the present exemplary embodiment, the second stack tray 102 includes a detector 140 for detecting the presence/absence of a sheet S. The detector 140 is disposed on the back side of a detection hole 141, which is formed in a region near a corner of the inclined portion 102*a* of the second stack tray 102 adjacent to the positioning wall 108. The detector 140 emits light from a light emitting element 143 and through the detection hole 141. When a sheet S is present on the second stack tray 102 so as to close the detection hole 141, the detector 140 receives light reflected from the sheet S, thereby detecting the presence of the sheet S.

Sheet Output Position on Second Stack Tray

Figure 9B:
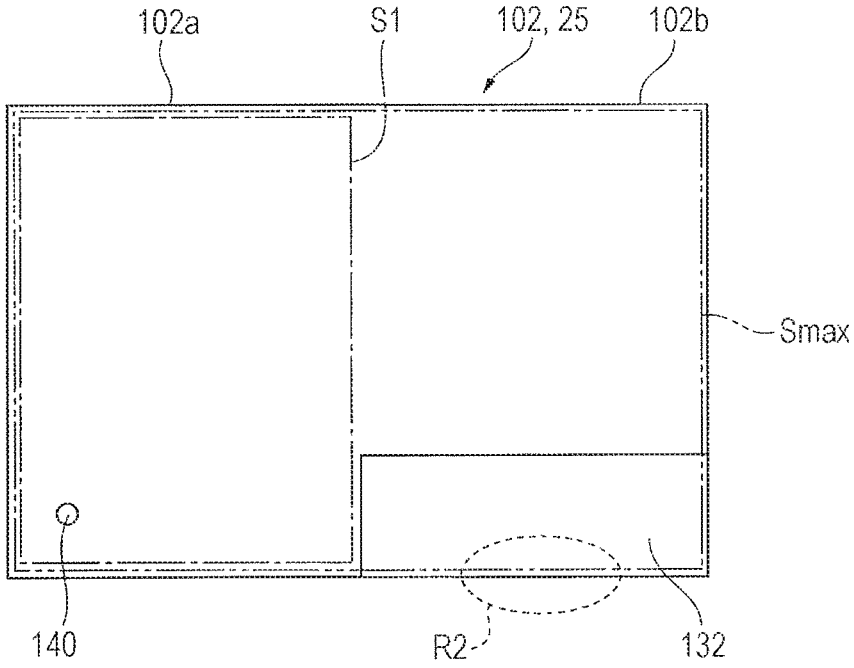
FIG. 9B illustrates an example of how sheets are held on the second stack tray.

Referring to FIG. 9B, in the present exemplary embodiment, the second stack tray 102 is sized so that it is capable of holding a maximum-sized (for example, JIS A3-sized) sheet Smax (which is shown by a two-dot chain line in FIG. 9B). The second stack tray 102 is capable of holding a frequently used standard-sized (for example, JIS A4-sized) sheet S1 (shown by an alternate long and short dash line in FIG. 9B) on a region corresponding to the inclined portion 102*a*. Therefore, in the present example, when a standard-sized sheet S1 is used, the sheet S1 does not overlap the second reflection member 132 of the second stack tray 102 and does not block the light beam Bm from the light source 121 toward the irradiation region R2.

Controller

Figure 10:
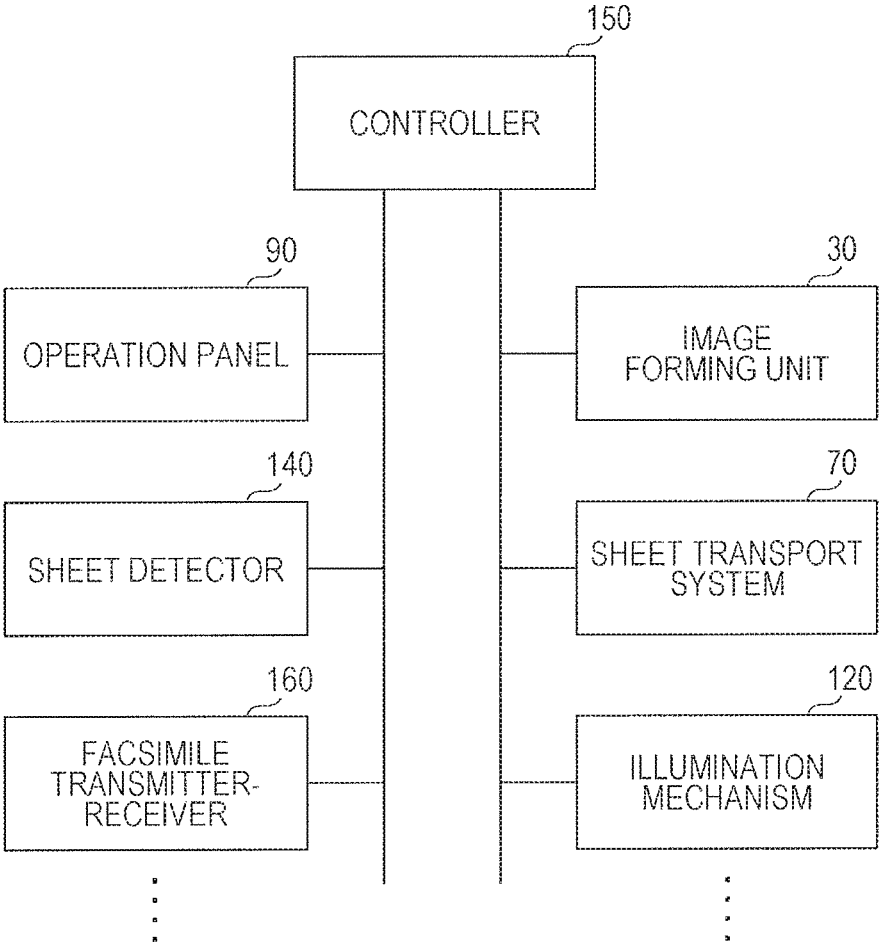
FIG. 10 is a block diagram of a control system of the image forming apparatus according to the first exemplary embodiment.

Referring to FIG. 10, in the present exemplary embodiment, the image forming apparatus 20 includes a controller 150. The controller 150 is a microcomputer including a CPU, a ROM, a RAM, and an I/O port. The ROM stores an image forming program used by the image forming units 30 (30*a* to 30*d*), a sheet transport control program used by the sheet transport system 70, and an illumination control program used by the illumination mechanism 120 to control illumination of the internal stacker 25 (see, for example, FIG. 11). When the controller 150 receives, through the I/O port, an input signal from the operation panel 90, a detection signal from the detector 140, and a transmission/reception signal from a facsimile transmitter-receiver 160, the controller 150 executes a corresponding control program by using the CPU. Then, the controller 150 sends, through the I/O port, necessary control signals to the image forming unit 30, the sheet transport system 70, the illumination mechanism 120, and the facsimile transmitter-receiver 160.

Operation of Image Forming Apparatus

Next, an operation of the image forming apparatus according to the present exemplary embodiment will be described.

In the present exemplary embodiment, the controller 150 enables the image forming apparatus to form an image in various modes, such as a print mode, a copy mode, and a facsimile output mode.

For example, in the print mode, in response to a print command received from a client that is connected to the image forming apparatus 20 through a LAN, the controller 150 controls the image forming units 30 (30*a* to 30*d*) and the sheet transport system 70 by executing a predetermined image forming program and a sheet transport control program. Then, the controller 150 causes a sheet S, on which an image has been formed, to be stacked on, for example, the first stack tray 101 of the internal stacker 25.

In the copy mode, the controller 150 reads an image captured by the scanner 22, executes a series of image forming programs and sheet transport control programs on the read image. Then, the controller 150 causes a sheet S, on which an image has been formed, to be stacked on, for example, the first stack tray 101 of the internal stacker 25.

In the facsimile output mode, the controller 150 executes a series of image forming programs and sheet transport control programs on an image signal received by the facsimile transmitter-receiver 160. Then, the controller 150 causes a sheet S, on which an image has been formed, to be stacked on, for example, the second stack tray 102 of the internal stacker 25 (which is selected as a dedicated tray for facsimile output in the present example).

Illumination Control of Internal Stacker

Figure 11:
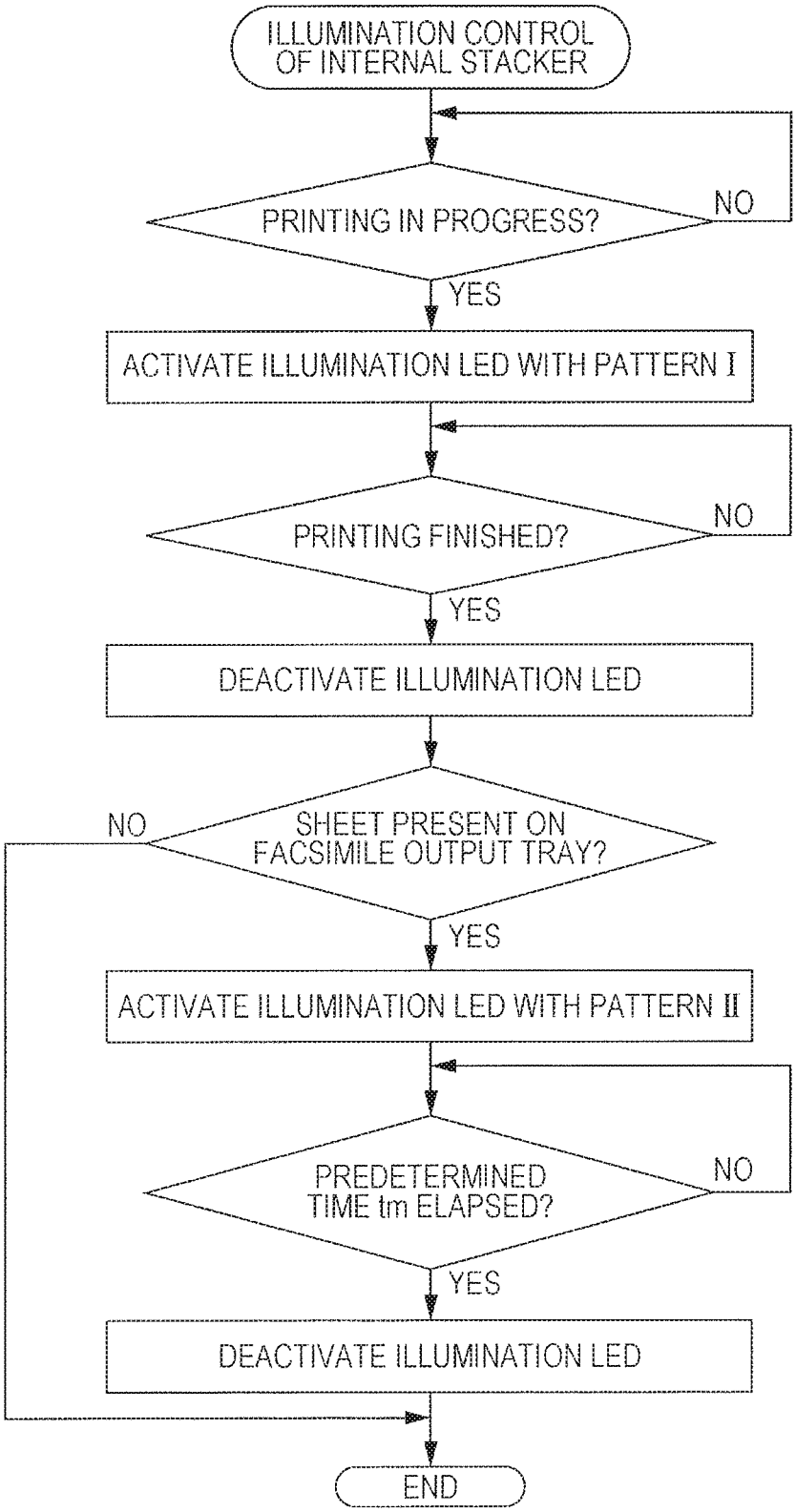
FIG. 11 is a flowchart of an illumination control process of the internal stacker of the image forming apparatus according to the first exemplary embodiment.

In the present exemplary embodiment, the controller 150 also performs illumination control of the internal stacker in the image forming modes as shown in FIG. 11.

Referring to FIG. 11, the controller 150 determines that printing is in progress (in any of the print mode, the copy mode, and the facsimile output mode) when an image forming program is being executed. During printing, the controller 150 activates the illumination LED 122, which is the light source 121 of the illumination mechanism 120 of the internal stacker 25, with a pattern I. When printing is finished, the controller 150 deactivates the illumination LED 122.

After the emission pattern I has been finished, the controller 150 determines whether or not the sheet S is present on a dedicated stack tray for facsimile output (which is the second stack tray 102 in the present example) by checking the output of the sheet detector 140. If the sheet S is present on the second stack tray 102, the controller 150 activates the illumination LED 122 with a pattern II. Subsequently, if a predetermined time tm has elapsed after activating the illumination LED 122, the controller 150 deactivates the illumination LED 122. In the present example, the LED 122 is deactivated when a predetermined time tm has elapsed after being activated in the emission pattern II. However, this is not a limitation. Alternatively, the presence/absence of the sheet S may be detected at predetermined intervals, and the LED 122 may be continued to be activated until the sheet S is taken out of the second stack tray 102. Further alternatively, after repeating the operation of detecting of the presence/absence of a sheet S a predetermined number of times, the illumination LED 122 may be deactivated regardless of the presence/absence of the sheet S.

The emission patterns I and II of activating the illumination LED 122 will be described.

Figure 12A:
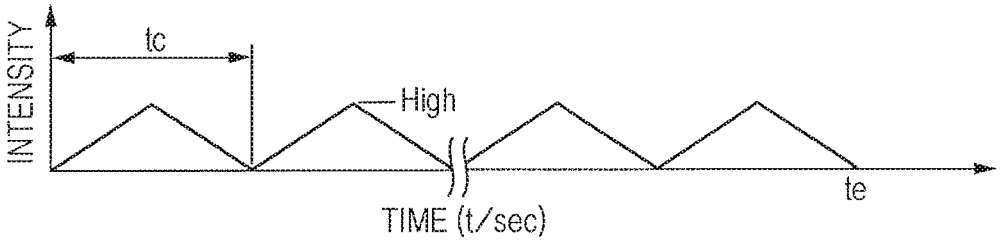
FIG. 12A is a diagram illustrating an emission pattern I of the illumination control process of the internal stacker according to the first exemplary embodiment.

Referring to FIG. 12A, in the emission pattern I, the intensity of light emitted from the illumination LED 122 is increased and decreased repeatedly with a predetermined period tc by gradually increasing the intensity from zero to a high level and then gradually decreasing the intensity from the high level to zero. Thus, in the emission pattern I, the brightness level of the illumination LED 122 is changed with a regular cyclic pattern to inform a user around the image forming apparatus that printing is in progress.

In this example, the peak value of the emission intensity of the illumination LED 122 is the high level. However, this is not a limitation. Alternatively, the peak value of the emission intensity may be a predetermined medium level (Mid). The minimum value may be a predetermined low level that is not zero.

Figure 12B:
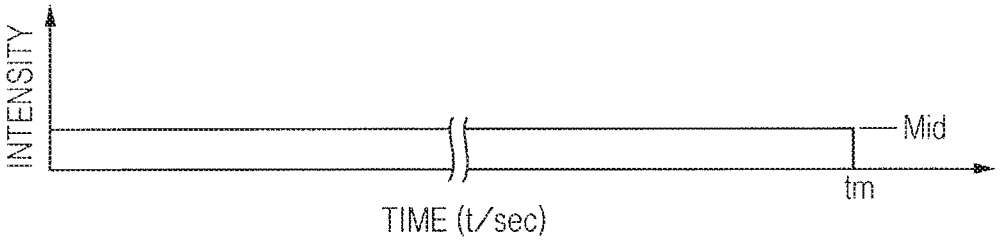
FIG. 12B is a diagram illustrating an emission pattern II of the illumination control process.

Referring to FIG. 12B, in the emission pattern II, the intensity of light emitted from the illumination LED 122 is constant (at, for example, the mid level), and the illumination LED 122 is deactivated when a predetermined time tm has elapsed.

Hereinafter, specific examples of illumination control of the internal stacker 25 will be described.

Print Mode

Figure 13A:
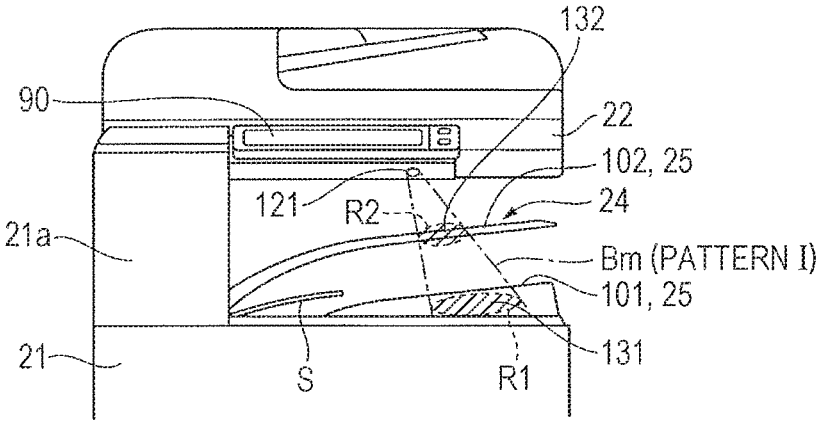
FIGS. 13A to 13C illustrate an example of how the internal stacker of the image forming apparatus according to the first exemplary embodiment is illuminated when the image forming apparatus performs printing (print start, print in progress, print finished) (excluding facsimile output)
Figure 13B:
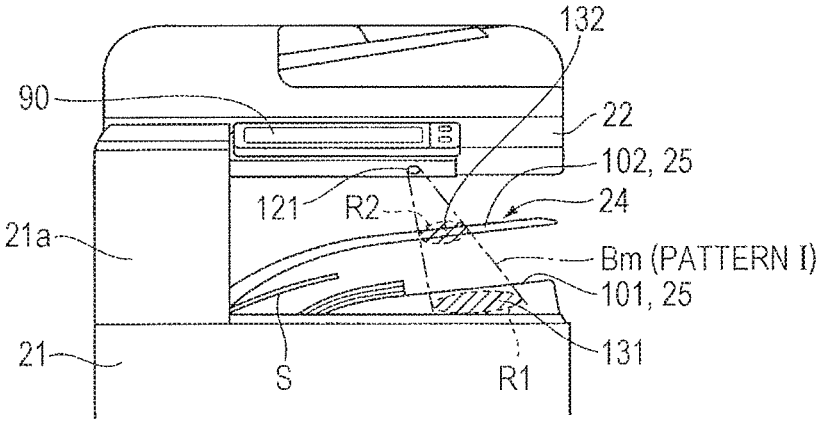
Figure 13C:
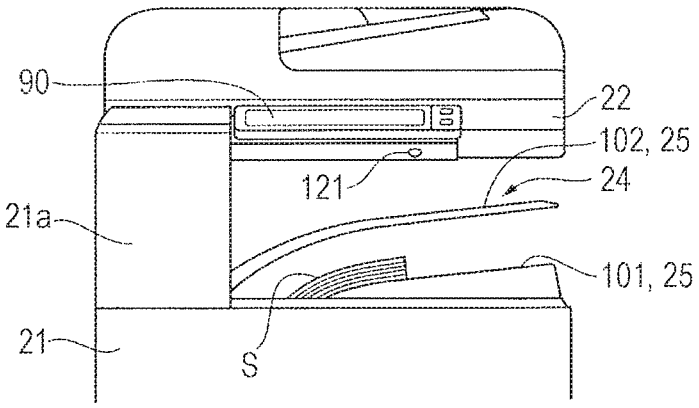

Referring to FIG. 13A, when a print mode of forming an image on a standard-sized sheet S is selected, the controller 150 starts activating the light source 121 of the illumination mechanism 120 with the pattern I. Referring to FIG. 13B, the light source 121 is continued to be activated with the pattern I while printing is in progress. Referring to FIG. 7, at this time, the light beam Bm from the light source 121 irradiates the irradiation region R2 of the second reflection member 132 and irradiates the irradiation region R1 of the first reflection member 131. Referring to FIG. 13C, the controller 150 deactivates the light source 121 when printing is finished.

In this state, the light beam Bm from the light source 121 irradiates the irradiation region R1 of the first reflection member 131 and the irradiation region R2 of the second reflection member 132. Moreover, a part of the light beam Bm is diffusely reflected by the inclined portion 133 of the first reflection member 131 laterally outward from the internal space 24, and another part of the light beam Bm is diffusely reflected by the reflecting surface 136 of the second reflection member 132 laterally outward from the internal space 24.

In the present example, the area of the irradiation region R2 of the second reflection member 132 is smaller than the area of the irradiation region R1 of the first reflection member 131. Moreover, the distance between the irradiation region R2 and the light source 121 is smaller than the distance between the irradiation region R1 and the light source 121. Therefore, the intensity of the light beam Bm reflected by the reflecting surface 136 of the second reflection member 132 is higher than the intensity of the light beam Bm reflected by the inclined portion 133, which functions as the reflecting surface of the first reflection member 131. Therefore, the light beam Bm reflected by the reflecting surface 136 of the second reflection member 132 reaches a position farther than the light beam Bm reflected by the inclined portion 133 of the first reflection member 131. Because the reflecting surface 136 of the second reflection member 132 and the inclined portion 133 of the first reflection member 131 are respectively textured to have the small-asperity surfaces 137 and 134, the light beam Bm is diffusely reflected and scattered to dimly illuminate a wide area. Therefore, with the present exemplary embodiment, it is possible for a user away from the image forming apparatus 20 to see that the light beam Bm from the second reflection member 132 is intense and the light beam Bm from the first reflection member 131 is weak. At this time, it is possible for the user to recognize that printing is in progress because the light beam Bm is emitted with the emission pattern I.

Facsimile Output Mode

Figure 14A:
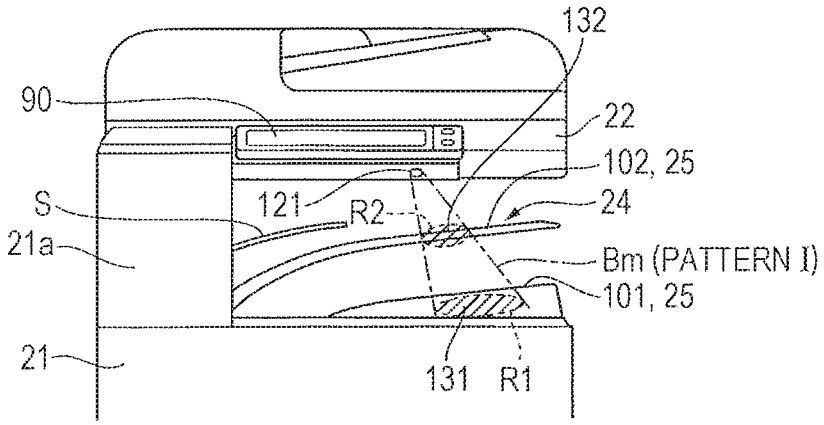
FIGS. 14A to 14C illustrate an example of how the internal stacker of the image forming apparatus according to the first exemplary embodiment is illuminated when the image forming apparatus performs facsimile output (facsimile output start, facsimile output in progress, facsimile output finished)
Figure 14B:
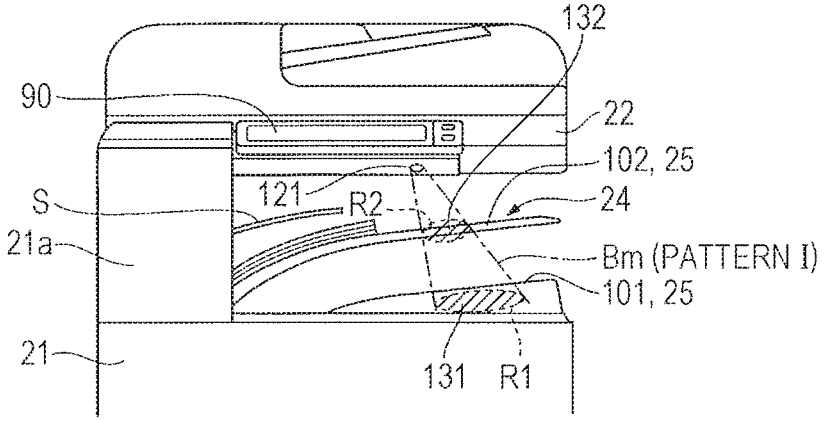
Figure 14C:
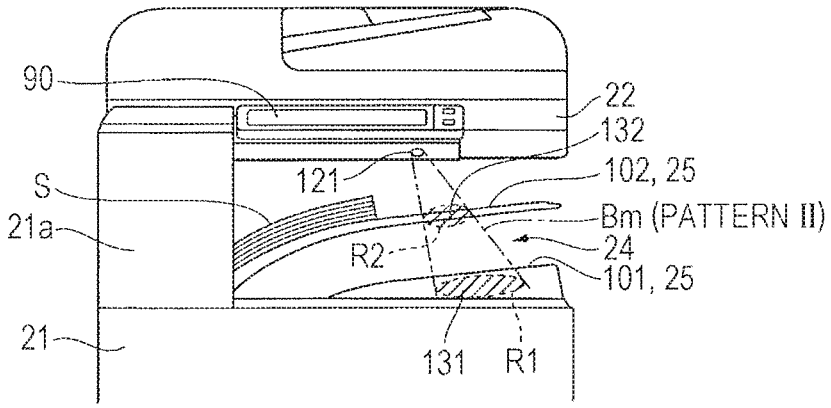

Referring to FIG. 14A, when a facsimile output mode of forming an image on a standard-sized sheet S is selected, the controller 150 starts activating the light source 121 of the illumination mechanism 120 with the pattern I. Referring to FIG. 14B, the controller 150 continues activating the light source 121 with the pattern I while facsimile output is in progress.

In this state, the sheet S is stacked on the second stack tray 102, in contrast to the print mode. As in the print mode, the light beam Bm from the light source 121 irradiates the irradiation region R1 of the first reflection member 131 and the irradiation region R2 of the second reflection member 132. Moreover, a part of the light beam Bm is diffusely reflected by the inclined portion 133 of the first reflection member 131 laterally outward from the internal space 24, and another part of the light beam Bm is diffusely reflected by the reflecting surface 136 of the second reflection member 132 laterally outward from the internal space 24. Therefore, in the present example, in the facsimile output mode, the illumination mechanism 120 of the internal stacker 25 functions in the same way as in the print mode.

However, the facsimile output mode differs from the print mode in that the controller 150 detects whether the sheet S is present on the second stack tray 102 when facsimile output is finished. If the sheet S is present, the controller 150 activates the light source 121 with the pattern II. Therefore, the light beam Bm is continued to be reflected from the first reflection member 131 and the second reflection member 132 with a constant intensity until a predetermined time tm elapses. Thus, it is possible for a user away from the image forming apparatus 20 to see the light beam Bm with the pattern II and to recognize that the sheet S, which is output as a facsimile output, has not been removed from the second stack tray 102.

In the present example, a part of the light beam Bm is reflected by the first reflection member 131, and another part of the light beam Bm is reflected by the second reflection member 132. However, this is not a limitation. For example, by adjusting the intensity of the light beam Bm emitted from the light source 121, the intensity of the part of the light beam Bm reflected from the first reflection member 131 may be sufficiently reduced so that only the other part of the light beam Bm reflected by the second reflection member 132 is visible.

Maximum-Sized Sheet Output Mode

Figure 15A:
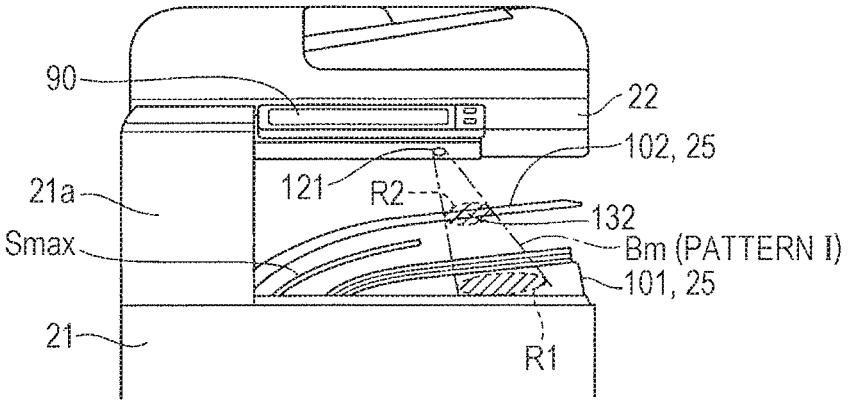
FIGS. 15A to 15C illustrate an example of how the internal stacker of the image forming apparatus according to the first exemplary embodiment is illuminated when the image forming apparatus outputs a maximum-sized sheet (print (excluding facsimile output) in progress, facsimile output in progress, facsimile output finished)

Referring to FIG. 15A, when a print mode of forming an image on a maximum-sized sheet Smax is selected, the controller 150 starts activating the light source 121 of the illumination mechanism 120 with the pattern I. The controller 150 continues activating the light source 121 with the pattern I while printing is in progress. Referring to FIG. 7, at this time, the light beam Bm from the light source 121 irradiates the irradiation region R2 of the second reflection member 132 and irradiates the irradiation region R1 of the first reflection member 131.

In this state, because the sheet Smax on which an image has been formed is stacked on the first stack tray 101, even if the sheet Smax is placed so as to overlap the first reflection member 131 of the first stack tray 101, the light beam Bm from the light source 121 is reflected by the reflecting surface 136 of the second reflection member 132 laterally outward from the internal space 24. Thus, it is possible for a user to see the light beam Bm with the pattern I, which is reflected by the second reflection member 132, and to recognize that printing on the maximum-sized sheet Smax is in progress.

Figure 15B:
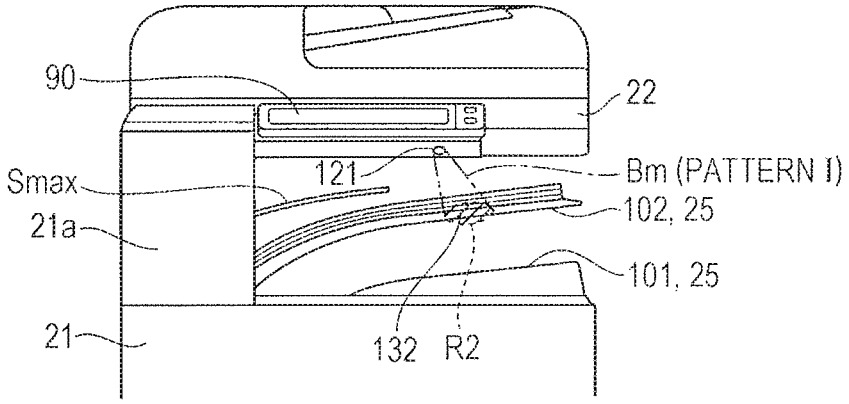
Figure 15C:
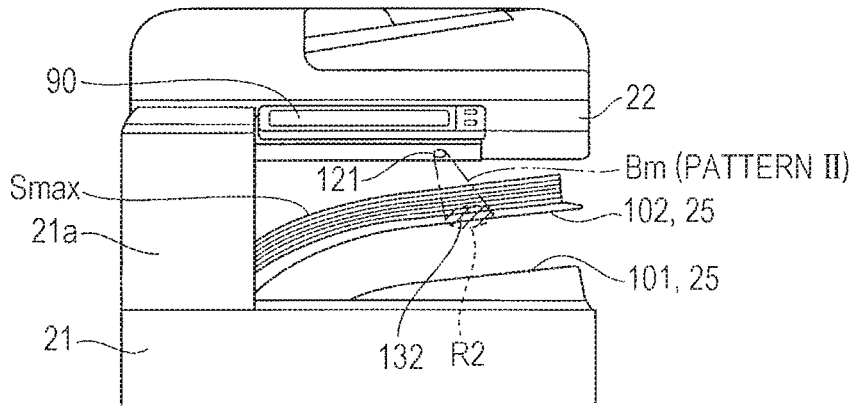

Referring to FIG. 15B, when a facsimile output mode of forming an image on a maximum-sized sheet Smax is selected, the controller 150 starts activating the light source 121 of the illumination mechanism 120 with the pattern I. The controller 150 continues activating the light source 121 with the pattern I while facsimile output is in progress. Referring to FIG. 7, at this time, the light beam Bm from the light source 121 irradiates the irradiation region R2 of the second reflection member 132.

In this state, the sheet Smax, which is output as a facsimile output, is stacked on the second stack tray 102. Therefore, referring to FIG. 9B, the sheet Smax is placed so as to overlap the second reflection member 132 of the second stack tray 102. In this case, because the rigidity of the sheet Smax is comparatively low due to its large size, a part of the sheet Smax overlapping the second reflection member 132 becomes warped along the reflecting surface 136 of the second reflection member 132. Therefore, the light beam Bm from the light source 121, which has a non-white color (in the present example, blue), is reflected by the sheet Smax, which extends along the reflecting surface 136 of the second reflection member 132, laterally outward from the internal space 24. Therefore, it is possible to for a user to recognize that facsimile output to the maximum-sized sheet Smax is in progress by seeing the light beam Bm with the pattern I, which is reflected by the sheet Smax extending along the reflecting surface 136 of the second reflection member 132. In the present example, because most of the light beam Bm from the light source 121 is reflected by the sheet Smax, the amount of the light beam Bm from the light source 121 that reaches the irradiation region R1 of the first reflection member 131 is negligibly small.

When the facsimile output is finished, the controller 150 detects the presence/absence of a sheet Smax on the second stack tray 102. If the sheet Smax is present, the controller 150 starts activating the light source 121 with the pattern II and continues activating the light source 121 with a constant level until a predetermined time tm elapses. In this case, the sheet Smax is placed so as to overlap the second reflection member 132 of the second stack tray 102. As described above, a part of the sheet Smax overlapping the second reflection member 132 becomes warped along the reflecting surface 136 of the second reflection member 132. Therefore, as described above, the light beam Bm from the light source 121 is reflected by the sheet Smax, which extends along the reflecting surface 136 of the second reflection member 132, laterally outward from the internal space 24. Thus, it is possible for a user away from the image forming apparatus 20 to see the light beam Bm with the pattern II and to recognize that the maximum-sized sheet Smax, which is output as a facsimile output, has not been removed from the second stack tray 102. In the present example, because most of the light beam Bm from the light source 121 is reflected by the sheet Smax, the amount of the light beam Bm from the light source 121 that reaches the irradiation region R1 of the first reflection member 131 is negligibly small.

Example without Second Stack Tray

In the present exemplary embodiment, the second stack tray 102 is removably mounted in the internal stacker 25. Therefore, a user may remove the second stack tray 102 when, for example, the side stack tray 28 is used for facsimile output.

In this case, the internal stacker 25 has only the first stack tray 101.

Figure 16A:
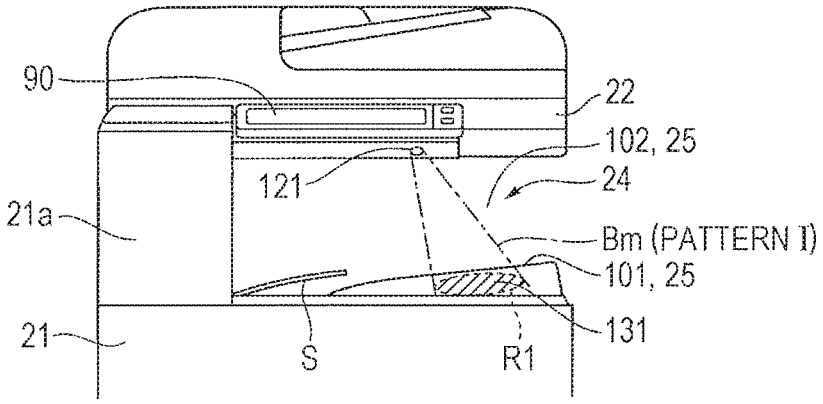
FIGS. 16A to 16C illustrate an example of how the internal stacker of the image forming apparatus according to the first exemplary embodiment, from which the second stacking tray is removed, is illuminated when the image forming apparatus performs printing (excluding facsimile output) (print start, print in progress, print finished)
Figure 16B:
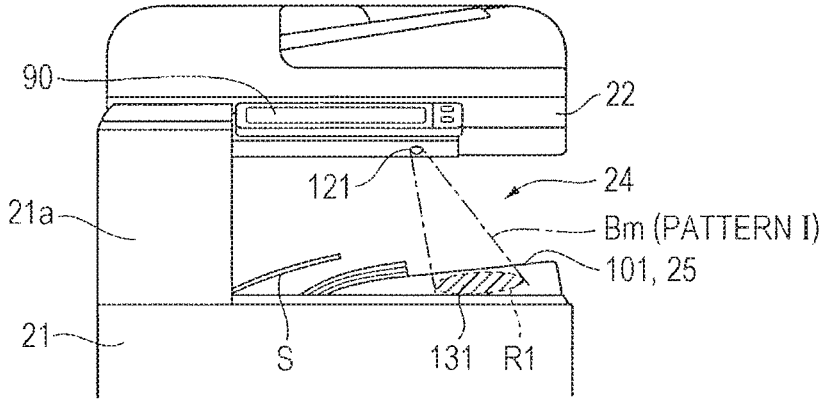
Figure 16C:
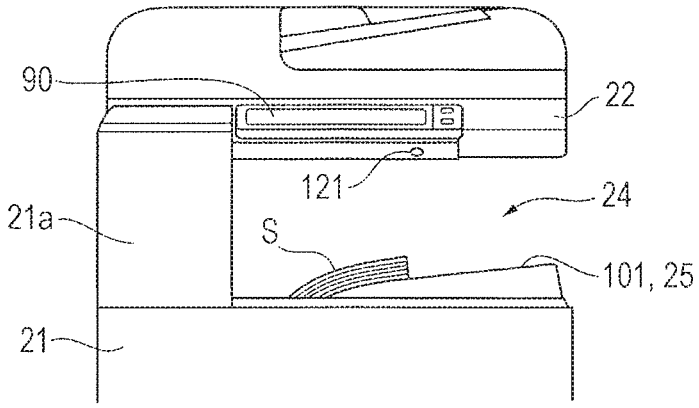

Referring to FIG. 16A, when a print mode of printing an image on a standard-sized sheet S is selected, the controller 150 starts activating the light source 121 of the illumination mechanism 120 with the pattern I. Referring to FIG. 16B, the controller 150 continues activating the light source 121 with the pattern I while printing is in progress. At this time, the light beam Bm from the light source 121 irradiates the irradiation region R1 of the first reflection member 131. Referring to FIG. 16C, the controller 150 deactivates the light source 121 when printing is finished.

Thus, in the present exemplary embodiment, the second stack tray 102 is removably mounted in the internal stacker 25, and it is possible to perform illumination control of the internal stacker 25 in either of cases where the second stack tray 102 is mounted or removed.

Second Exemplary Embodiment

Figure 17B:
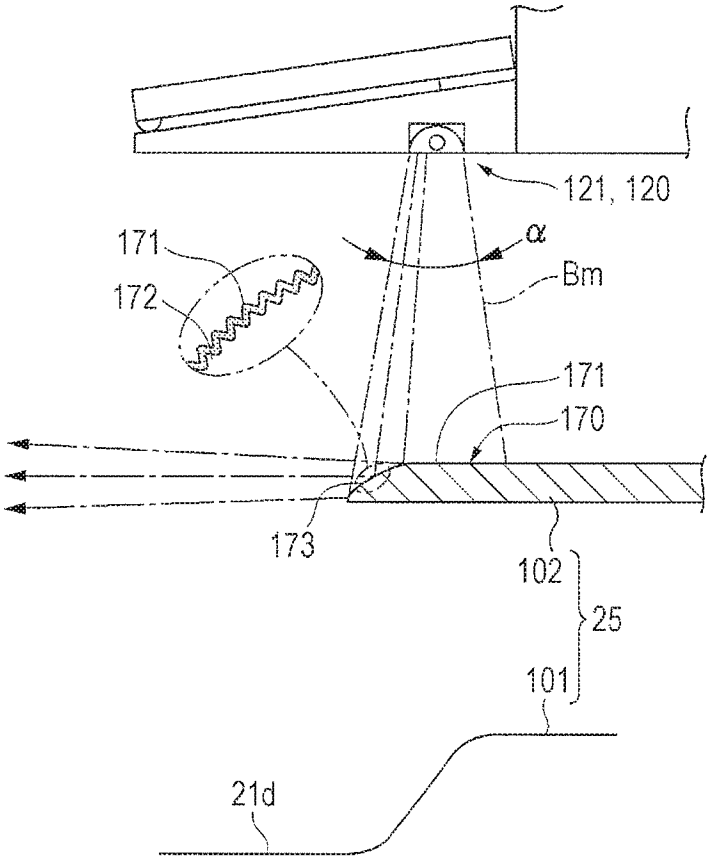
FIG. 17B is a partial schematic view seen in the direction of arrow XVIIB in FIG. 17A.
Figure 17A:
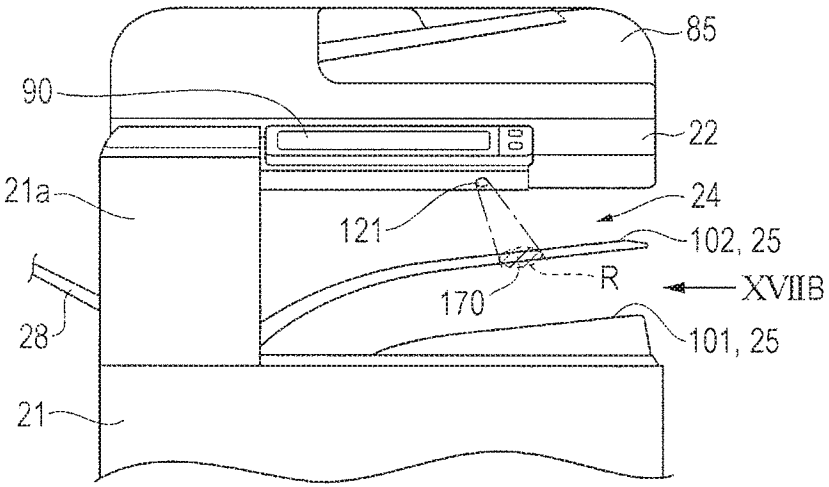
FIG. 17A is a partial view of an image forming apparatus according to a second exemplary embodiment, illustrating an internal stacker and the surrounding region.

FIGS. 17A and 17B illustrate a part of an image forming apparatus according to a second exemplary embodiment.

Referring to FIGS. 17A and 17B, the illumination mechanism 120 of the internal stacker 25 includes a light source 121 and a reflection member 170. The light source 121 is disposed on a part of the support table 21*c* of the housing 21. The reflection member 170 is disposed on a part of the extended portion 102*b* of the second stack tray 102 near the operation panel 90. The reflection member 170 reflects a light beam Bm emitted from the light source 121 laterally outward from the internal space 24. Elements of the second exemplary embodiment that are the same as those of the first exemplary embodiment will be denoted by the same numerals, and detailed descriptions of such elements will be omitted.

In the present exemplary embodiment, the second stack tray 102 is an opaque member. A part of the extended portion

102*b* of the second stack tray 102 near the operation panel 90 also serves as the reflection member 170. The reflection member 170 has a reflecting surface 171, which has a higher reflectivity that other portions, formed on at least a part of a region including an irradiation region R irradiated with the light beam Bm from the light source 121. The reflecting surface 171 is, for example, textured to have a small-asperity surface 172. An edge portion 173 is formed in an end portion of the reflecting surface 171 near an outer side the internal space 24 so as to be curved or inclined downward.

In the present example, the light beam Bm from the light source 121 is almost entirety reflected by the reflection member 170 of the second stack tray 102, so that the amount of the light beam Bm that reaches the first stack tray 101 is negligibly small.

Figure 18A:
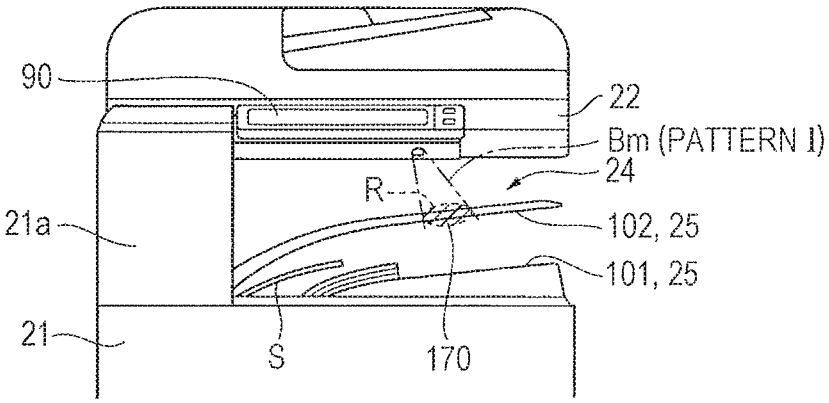
FIGS. 18A to 18C illustrate an example of how the internal stacker of the image forming apparatus according to the second exemplary embodiment is illuminated when the image forming apparatus performs printing (printing (excluding facsimile output) in progress, facsimile output in progress, facsimile output finished)

Referring to FIG. 18A, in the present exemplary embodiment, in a print mode, a controller (not shown) causes the sheet S for printing (in the present example, a standard-sized sheet) to be stacked on the first stack tray 101 of the internal stacker 25, and activates the light source 121 with the pattern I as illumination control of the internal stacker 25. At this time, a light beam Bm from the light source 121 illuminates the irradiation region R of the reflection member 170 of the second stack tray 102 and is reflected by the reflecting surface 171. In particular, because the reflecting surface 171 has the small-asperity surface 172, a part of the light beam Bm from the reflecting surface 171 is diffusely reflected and scattered, and another part of the light beam Bm is reflected by the edge portion 173 of the reflecting surface 171 laterally outward from the internal space 24.

Therefore, it is possible for a user away from the image forming apparatus to see the other part of the light beam Bm with the pattern I, which is reflected from the edge portion 173 of the reflection member 170, and to recognize that printing is in progress.

Figure 18B:
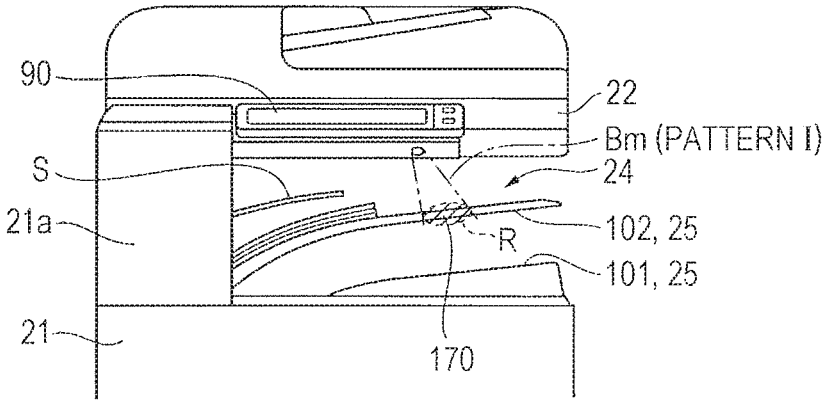

Referring to FIG. 18B, in a facsimile output mode, the controller (not shown) causes the sheet S for facsimile output (in the present example, a standard-sized sheet) to be stacked on the second stack tray 102 of the internal stacker 25 and activates the light source 121 with the pattern I as illumination control of the internal stacker 25. At this time, as in the print mode, the light beam Bm from the light source 121 irradiates the irradiation region R of the reflection member 170 of the second stack tray 102 and a part of the light beam Bm is reflected by the reflecting surface 171. Therefore, it is possible for a user away from the image forming apparatus to see the part of the light beam Bm with the pattern I reflected from the edge portion 173 of the reflection member 170 and to recognize that facsimile output is in progress.

Figure 18C:
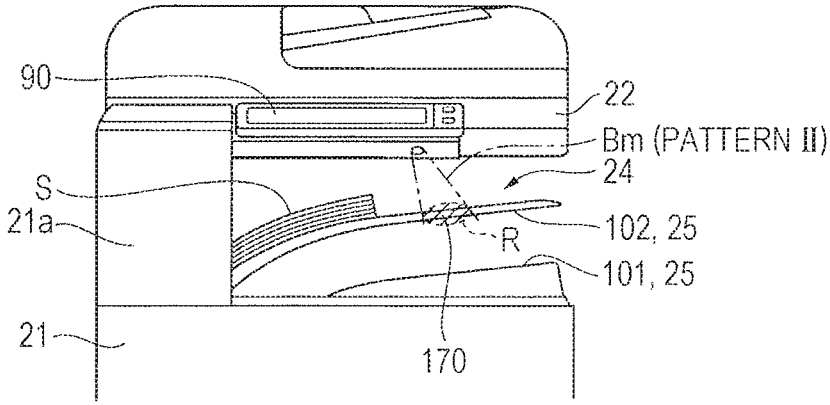

Referring to FIG. 18C, when the facsimile output is finished, the controller (not shown) detects, as illumination control of the internal stacker 25, the presence/absence of the sheet S on the second stack tray 102 by using the sheet detector 140. If the sheet S is present, the controller activates the light source 121 with the pattern II. In this state, it is possible for a user away from the image forming apparatus to see a part of the light beam Bm with the pattern II reflected from the edge portion 173 of the reflection member 170 and to recognize that the sheet S, which is output as a facsimile output, has not been removed from the second stack tray 102.

Third Exemplary Embodiment

Figure 19B:
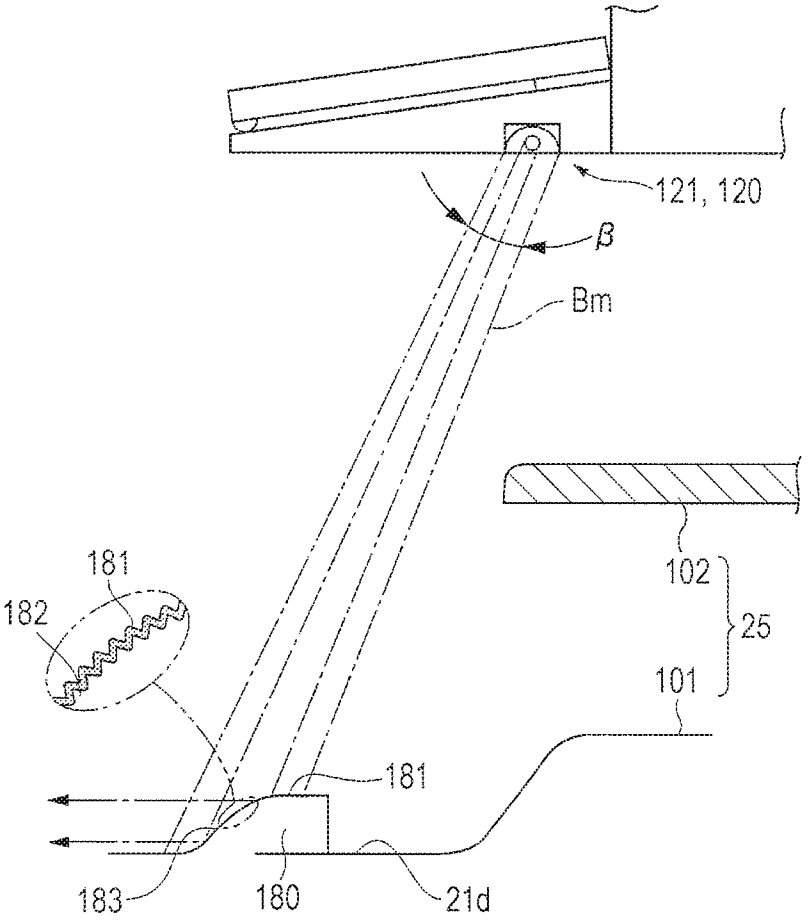
FIG. 19B is a partial schematic view seen in the direction of arrow XIXB in FIG. 19A.
Figure 19A:
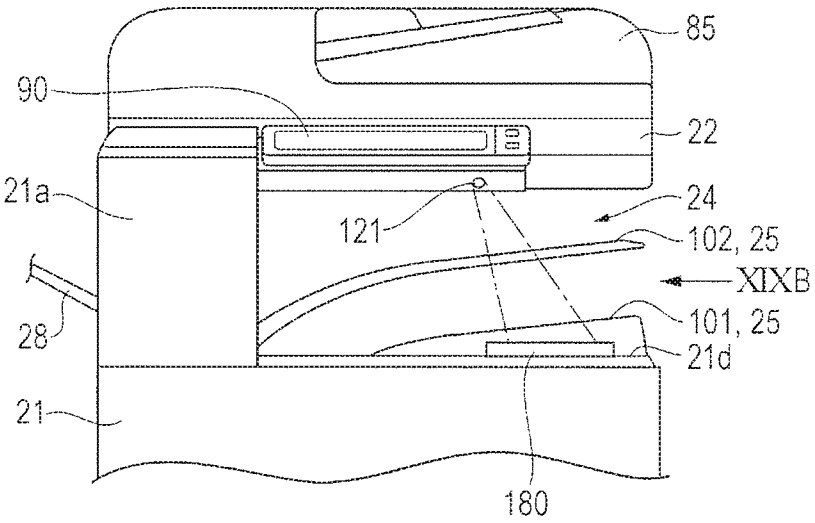
FIG. 19A is a partial view of an image forming apparatus according to a third exemplary embodiment, illustrating an internal stacker and the surrounding region.
Figure 20:
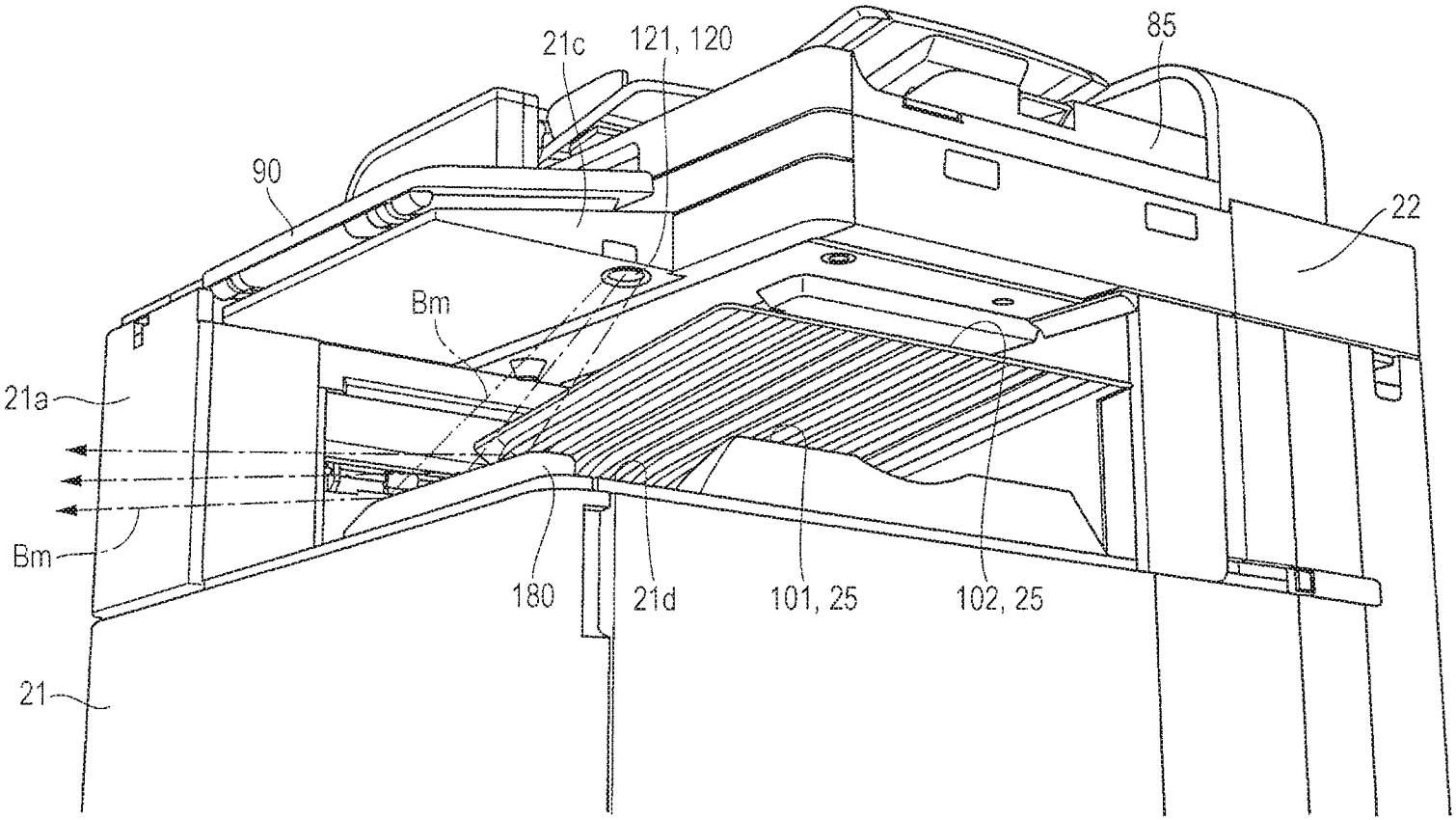
FIG. 20 is a partial perspective view of the image forming apparatus according to the third exemplary embodiment, illustrating the internal stacker seen from diagonally below.

FIGS. 19A, 19B, and 20 illustrate a part of an image forming apparatus according to a third exemplary embodiment.

Referring to FIGS. 19A, 19B, and 20, the illumination mechanism 120 of the internal stacker 25 includes a light source 121 and a reflection member 180. The light source 121 is disposed on a part of the support table 21*c* of the housing 21. The reflection member 180, which is independent from the first stack tray 101, is disposed on the stepped portion of the housing 21. The reflection member 180 reflects a light beam Bm, which is emitted from the light source 121, laterally outward from the internal space 24. Elements of the third exemplary embodiment that are the same as those of the first exemplary embodiment will be denoted by the same numerals, and detailed descriptions of such elements will be omitted.

In the present exemplary embodiment, the reflection member 180 has a reflecting surface 181, which has a higher reflectivity, on at least a part of a region including an irradiation region R irradiated with the light beam Bm from the light source 121. The reflecting surface 181 is, for example, textured to have a small-asperity surface 182. An edge portion 183 is formed on an end portion of the reflecting surface 181 near an outer side of the internal space 24 so as to be curved or inclined downward.

In the present example, the light source 121 emits the light beam Bm with a predetermined irradiation range β so that the light beam Bm travels along an optical path that does not extend through the second stack tray 102 toward the reflection member 180, which is disposed on the stepped portion 21*d* of the housing 21.

Figure 21A:
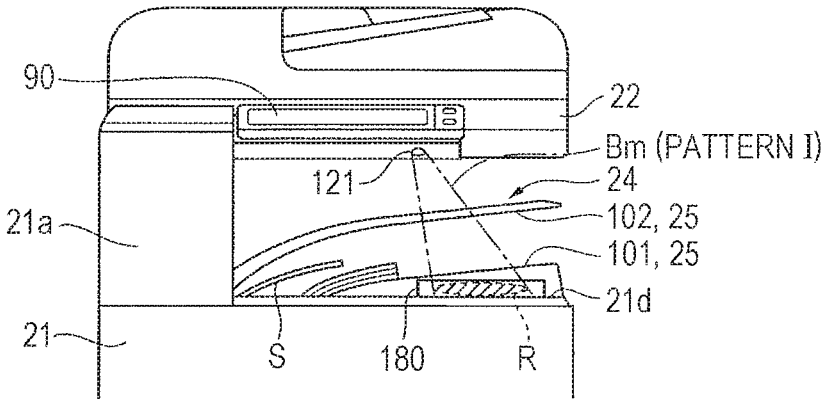
FIGS. 21A to 21C illustrate an example of how the internal stacker of the image forming apparatus according to the third exemplary embodiment is illuminated when the image forming apparatus performs printing (printing (excluding facsimile output) in progress, facsimile output in progress, facsimile output finished).

Referring to FIG. 21A, in the present exemplary embodiment, in a print mode, a controller (not shown) causes the sheet S (in the present example, a standard-sized sheet) to be stacked on the first stack tray 101 of the internal stacker 25, and activates the light source 121 with the pattern I as illumination control of the internal stacker 25. At this time, the light beam Bm from the light source 121 irradiates the irradiation region R of the reflection member 180, which is disposed on the stepped portion 21*d* of the housing 21, and a part of the light beam Bm is reflected by the reflecting surface 181. In particular, the part of the light beam Bm is diffusely reflected by the reflecting surface 181 because the reflecting surface 181 has the small-asperity surface 182, and another part of the light beam Bm is reflected by the edge portion 183 of the reflecting surface 181 laterally outward from the internal space 24.

Therefore, it is possible for a user away from the image forming apparatus to see the other part of the light beam Bm with the pattern I, which is reflected from the edge portion 183 of the reflection member 180, and to recognize that printing is in progress.

Figure 21B:
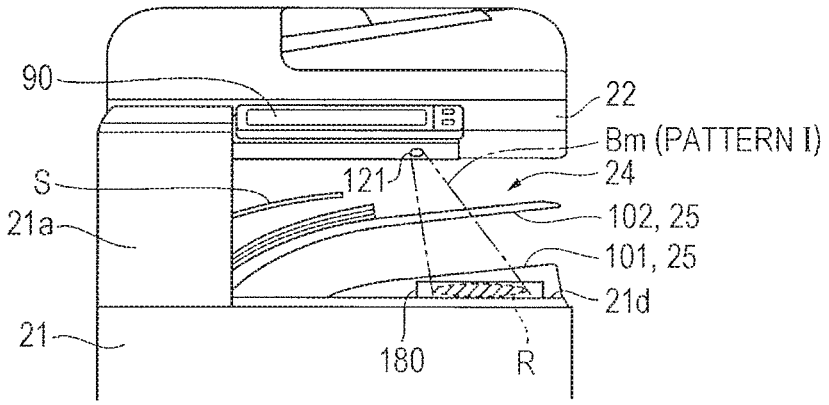

Referring to FIG. 21B, in the facsimile output mode, the controller (not shown) causes the sheet S (in the present example, a standard-sized sheet) for facsimile output to be stacked on the second stack tray 102 of the internal stacker 25 and activates the light source 121 with the pattern I as illumination control of the internal stacker 25. At this time, as in the print mode, the light beam Bm from the light source 121 irradiates the irradiation region R of the reflection member 180, which is disposed on the stepped portion 21*d* of the housing 21, and a part of the light beam Bm is reflected by the reflecting surface 181. Therefore, it is possible for a user away from the image forming apparatus to see the part of the light beam Bm with the pattern I, which is reflected from the edge portion 183 of the reflection member 180, and to recognize that facsimile output is in progress.

Figure 21C:
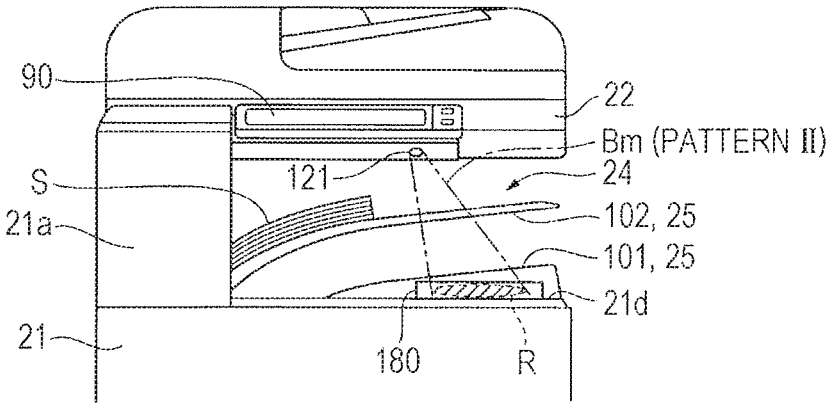

Referring to FIG. 21C, when the facsimile output is finished, the controller (not shown) detects, as illumination control of the internal stacker 25, the presence/absence of the sheet S on the second stack tray 102 by using the sheet detector 140. If the sheet S is present, the controller activates the light source 121 with the pattern II. In this state, it is possible for a user away from the image forming apparatus to see the part of the light beam Bm with the pattern II, which is reflected from the edge portion 183 of the reflection member 180, and to recognize that the sheet S, which is output as a facsimile output, has not been removed from the second stack tray 102.

In the present exemplary embodiment, the second stack tray 102 has no reflection member. However, for example, the second stack tray 102 may have a second reflection member 132 similar to that of the first exemplary embodiment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording medium processing apparatus comprising:

a housing that accommodates a processing unit, which is capable of processing a recording medium, and that has an internal space a part of which is open;

an internal stacker that is disposed in the internal space and that allows the recording medium to be stacked thereon;

a light source that is disposed in a part of the internal stacker and that emits a light beam toward a predetermined position on the internal stacker, the light beam notifying a user of a state in which the recording medium is or is not stacked on the internal stacker; and a reflection member that is disposed in a part of the internal stacker and that reflects the light beam from the light source laterally outward from the internal stacker, wherein the reflection member has a reflecting surface that reflects the light beam from the light source, the reflecting surface being textured to have small asperities.

2. The recording medium processing apparatus according to claim 1, wherein the internal stacker includes a plurality of stack members so as to have a plurality of stack regions that are arranged vertically, and the reflection member is disposed on at least one of the stack members.

3. The recording medium processing apparatus according to claim 2, wherein a plurality of the reflection members are disposed on all of the plurality of stack members so as to face an irradiation range of the light beam emitted from the light source.

4. The recording medium processing apparatus according to claim 1, wherein the reflection member is disposed on a region of the internal stacker excluding a region on which a frequently used standard-sized recording medium is to be placed.

5. The recording medium processing apparatus according to claim 1, wherein the light source emits a non-white light beam.

6. The recording medium processing apparatus according to claim 1, further comprising:

a controller that controls, when there are one or more notifications about the state in which the recording medium is or is not stacked on the internal stacker, an emission pattern of the light beam from the light source in accordance with contents of the notifications.

7. The recording medium processing apparatus according to claim 6, wherein, when notifying a state in which an operation of stacking a recording medium processed by the processing unit is in progress in the internal stacker, the controller selects an emission pattern of the light beam from the light source in which a brightness level of the light beam is gradually changed so that increase and decrease of the brightness level are repeated.

8. The recording medium processing apparatus according to claim 6, wherein the internal stacker includes a stack member on which a recording medium processed by the processing unit is to be stacked, and the stack member includes a detector that is capable of detecting presence/absence of the recording medium, and wherein, when the detector detects presence of a recording medium on the stack member as the state in which the recording medium is or is not stacked on the internal stacker, the controller activates the light source with a predetermined emission pattern on the basis of a detection signal of the detector.

9. A recording medium processing apparatus comprising:

a housing that accommodates a processing unit, which is capable of processing a recording medium, and that has an internal space a part of which is open;

an internal stacker that is disposed in the internal space and that allows the recording medium to be stacked thereon;

a light source that is disposed in a part of the internal stacker and that emits a light beam toward a predetermined position on the internal stacker, the light beam notifying a user of a state in which the recording medium is or is not stacked on the internal stacker; and a reflection member that is disposed in a part of the internal stacker and that reflects the light beam from the light source laterally outward from the internal stacker, wherein a part of a stack member of the internal stacker serves as the reflection member.

10. The recording medium processing apparatus according to claim 9, wherein the reflection member has a diffusely reflecting surface that diffusely reflects the light beam from the light source laterally outward from the internal stacker.

11. The recording medium processing apparatus according to claim 9, wherein the reflection member is a translucent member.

12. The recording medium processing apparatus according to claim 9, wherein the reflection member is disposed on at least an uppermost one of the plurality of stack members, and the reflection member is a translucent member.

13. A recording medium processing apparatus comprising a housing that accommodates a processing unit, which is capable of processing a recording medium, and that has an internal space a part of which is open;

an internal stacker that is disposed in the internal space and that allows the recording medium to be stacked thereon;

a light source that is disposed in a part of the internal stacker and that emits a light beam toward a predetermined position on the internal stacker, the light beam notifying a user of a state in which the recording medium is or is not stacked on the internal stacker; and a reflection member that is disposed in a part of the internal stacker and that reflects the light beam from the light source laterally outward from the internal stacker, wherein the recording medium processing apparatus has a facsimile function with which the processing unit forms an image, which has been transmitted thereto through a communication line, on a recording medium, and wherein the internal stacker includes a dedicated stack member that allows the recording medium, on which the transmitted image has been formed by using the facsimile function, to be stacked thereon, and the reflection member is disposed on the dedicated stack member, wherein the internal stacker includes a standard-equipment stack member disposed below the dedicated stack member, the standard-equipment stack member allowing a recording medium on which the processing unit has formed a non-facsimile image to be stacked thereon, and the reflection member is disposed on the standard-equipment stack member, and wherein the dedicated stack member is optional equipment and is removably disposed in a region that partitions the internal space vertically, and a reflection member made of a translucent material is disposed on the dedicated stack member in a region including an optical path of the light beam from the light source to the reflection member disposed on the standard-equipment stack member.

* * * * *